US009358429B2

(12) United States Patent
Vrska et al.

(10) Patent No.: US 9,358,429 B2
(45) **Date of Patent: *Jun. 7, 2016**

(54) GOLF CLUB ADJUSTABLE HOSEL ASSEMBLY

(71) Applicant: Wilson Sporting Goods Co., Chicago, IL (US)

(72) Inventors: Michael Vrska, Mundelein, IL (US); Mark Spencer, Chicago, IL (US); Richard P. Hulock, Wheaton, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/307,748

(22) Filed: Jun. 18, 2014

(65) Prior Publication Data

US 2015/0367185 A1 Dec. 24, 2015

(51) Int. Cl.

| | |
|---|---|
| ***A63B 53/02*** | (2015.01) |
| ***G09F 23/00*** | (2006.01) |
| ***A63B 53/04*** | (2015.01) |
| *A63B 71/06* | (2006.01) |

(52) U.S. Cl.

CPC ..... *A63B 53/02* (2013.01); *A63B 53/0466* (2013.01); *G09F 23/0066* (2013.01); *A63B 2053/023* (2013.01); *A63B 2071/0625* (2013.01); *A63B 2071/0694* (2013.01); *A63B 2209/00* (2013.01); *A63B 2209/02* (2013.01)

(58) Field of Classification Search

CPC ..... A63B 53/02; A63B 2053/023; A63B 2053/025; A63B 2053/026; A63B 2053/027; A63B 2071/0625; A63B 2071/0694; A63B 2209/00; A63B 2209/02; A63B 53/0466; G09F 23/0066

See application file for complete search history.

(56) References Cited

U.S. PATENT DOCUMENTS

| | | | | |
|---|---|---|---|---|
| 2,219,670 | A | 10/1940 | Wettlaufer | |
| 3,840,231 | A * | 10/1974 | Moore | 473/245 |
| 3,922,845 | A * | 12/1975 | Miyasaka et al. | 368/204 |
| 4,948,132 | A | 8/1990 | Wharton | |
| 5,197,733 | A | 3/1993 | Schroder | |
| 5,851,155 | A | 12/1998 | Wood et al. | |
| 5,951,411 | A | 9/1999 | Wood et al. | |
| 6,368,230 | B1 | 4/2002 | Helmstetter et al. | |
| 6,527,435 | B2 * | 3/2003 | Thalheim | 368/281 |
| 6,769,994 | B2 | 8/2004 | Boone | |
| 6,837,800 | B2 * | 1/2005 | Rollinson et al. | 473/244 |
| 7,083,529 | B2 | 8/2006 | Cackett et al. | |

(Continued)

FOREIGN PATENT DOCUMENTS

GB 2385539 A * 8/2003 ..... A63B 53/02

*Primary Examiner* — Stephen Blau

(74) *Attorney, Agent, or Firm* — Terence P. O'Brien

(57) ABSTRACT

An adjustable assembly includes a golf club shaft, a golf club head having a hosel portion with a hosel opening, a hosel insert, a shaft adapter, and a fastener. The hosel insert is secured to the hosel portion and includes at least one inwardly extending pawl. The adapter extends about a longitudinal axis, and defines a shaft opening. The adapter includes outwardly projecting teeth aligned with the hosel insert. Each tooth includes leading and trailing surfaces. The leading surface is shaped to enable rotational movement of the adapter about the axis with respect to the hosel insert in a first rotational direction. The trailing surface is shaped to selectively engage the pawl to inhibit rotational movement of the adapter with respect to the hosel insert in a second rotation direction that is opposite the first direction. The fastener is releasably coupled to the head and the adapter.

24 Claims, 15 Drawing Sheets

(56) References Cited

U.S. PATENT DOCUMENTS 7,326,126 B2 2/2008 Holt et al.
7,335,113 B2 2/2008 Hocknell et al.
7,344,449 B2 3/2008 Hocknell et al.
7,427,239 B2 9/2008 Hocknell et al.
7,465,239 B2 12/2008 Hocknell et al.
7,476,160 B2 1/2009 Hocknell et al.
7,530,900 B2 5/2009 Holt et al.
7,578,749 B2 8/2009 Hocknell et al.
7,611,422 B2 11/2009 Hocknell et al.
7,621,820 B2 11/2009 Clausen et al.
7,686,061 B2 * 3/2010 Mullet et al. ..... 160/191
7,699,717 B2 4/2010 Morris et al.
7,704,156 B2 4/2010 Stites et al.
7,722,474 B2 5/2010 Thomas et al.
7,722,475 B2 5/2010 Thomas et al.
7,789,766 B2 9/2010 Morris et al.
7,789,769 B2 9/2010 Sugimoto
7,850,540 B2 12/2010 Sander et al.
7,874,934 B2 1/2011 Soracco et al.
7,878,921 B2 2/2011 Bennett et al.
7,878,924 B2 2/2011 Clausen et al.
7,883,430 B2 2/2011 Thomas et al.
7,887,431 B2 2/2011 Beach et al.
7,931,542 B2 4/2011 Kusumoto
7,931,543 B2 4/2011 Burrows
7,938,735 B2 5/2011 Lau
7,955,182 B2 6/2011 Thomas et al.
7,955,183 B2 6/2011 Burrows
7,955,184 B2 6/2011 Stites et al.
7,955,185 B2 6/2011 Tavares et al.
7,963,855 B2 6/2011 Sander et al.
7,963,856 B2 6/2011 Yamamoto
7,976,401 B2 7/2011 Sato et al.
7,980,959 B2 7/2011 Morris et al.
7,997,997 B2 8/2011 Bennett et al.
8,002,644 B2 8/2011 Hocknell et al.
8,025,587 B2 9/2011 Beach et al.
8,029,383 B2 10/2011 Yamamoto
8,057,320 B2 11/2011 Bennett et al.
8,075,417 B2 12/2011 Thomas et al.
8,079,128 B2 12/2011 Sander et al.
8,083,608 B2 12/2011 Thomas et al.
8,096,894 B2 1/2012 Sander
8,096,895 B2 1/2012 Hocknell et al.
8,147,349 B2 4/2012 Thomas et al.
8,147,350 B2 4/2012 Beach et al.
8,147,351 B2 * 4/2012 Bennett et al. ..... 473/307
8,177,657 B2 5/2012 Clausen et al.
8,177,661 B2 5/2012 Beach et al.
8,182,357 B2 5/2012 Moore
8,182,358 B2 5/2012 Sander et al.
8,235,831 B2 8/2012 Beach et al.
8,235,834 B2 8/2012 De La Cuz et al.
8,235,835 B2 8/2012 Soracco
8,235,836 B2 8/2012 Soracco et al.
8,235,837 B2 8/2012 Bennett et al.
8,235,839 B2 8/2012 Bennett et al.
8,235,840 B2 8/2012 Hocknell et al.
8,246,484 B2 8/2012 Sato et al.
8,257,193 B2 9/2012 Hocknell et al.
8,262,498 B2 9/2012 Beach et al.
8,262,499 B2 9/2012 Murphy
8,277,333 B2 10/2012 Thomas et al.
8,303,431 B2 11/2012 Beach et al.
8,337,319 B2 12/2012 Sargent et al.
8,360,897 B2 1/2013 Morris et al.
8,376,874 B2 2/2013 Bennett et al.
8,382,607 B2 2/2013 Burnett et al.
8,398,503 B2 3/2013 Beach et al.
8,403,770 B1 3/2013 Aguinaldo et al.
8,403,772 B2 3/2013 Clausen et al.
8,419,563 B2 4/2013 Sander et al.
8,449,404 B2 5/2013 Thomas et al.
8,496,539 B2 7/2013 Solheim et al.
8,496,540 B2 7/2013 Soracco et al.
8,496,541 B2 7/2013 Beach et al.
8,517,855 B2 8/2013 Beach et al.
8,517,856 B2 8/2013 Bennett et al.
8,523,229 B1 * 9/2013 Kohlndorfer ..... 280/801.2
8,523,700 B2 9/2013 Sander
8,523,701 B2 * 9/2013 Knutson et al. ..... 473/307
8,535,172 B2 9/2013 O'Shea, III et al.
8,535,268 B2 * 9/2013 Auld et al. ..... 604/151
8,545,344 B2 * 10/2013 De La Cruz et al. ..... 473/288
8,562,454 B2 10/2013 Burch
8,574,092 B2 11/2013 Galloway et al.
8,585,511 B2 11/2013 Sato et al.
8,591,226 B2 * 11/2013 Griffith et al. ..... 433/24
8,602,907 B2 12/2013 Beach et al.
8,622,847 B2 1/2014 Beach et al.
8,628,430 B2 1/2014 Sato et al.
8,632,417 B2 1/2014 Sander et al.
8,636,606 B2 1/2014 Sato
8,641,554 B1 2/2014 Hocknell et al.
8,668,596 B2 3/2014 Cackett et al.
8,668,597 B2 3/2014 Yamamoto
8,696,486 B1 4/2014 Aguinaldo et al.
8,696,487 B2 4/2014 Beach et al.
8,727,899 B1 5/2014 Galloway
8,727,900 B2 5/2014 Beach et al.
8,727,905 B2 * 5/2014 Murphy et al. ..... 473/307
8,727,906 B1 5/2014 Aguinaldo et al.
8,747,248 B2 6/2014 Harvell et al.
8,747,249 B2 6/2014 Burrows
8,753,221 B1 6/2014 Aguinaldo et al.
8,777,990 B2 * 7/2014 van der Burg et al. ..... 606/232
8,992,573 B2 * 3/2015 Van Der Burg et al. ..... 606/232
2006/0293133 A1 * 12/2006 Simpson ..... 474/109
2012/0316006 A1 12/2012 Kitagawa et al.
2013/0005497 A1 1/2013 Beach et al.
2013/0005498 A1 1/2013 Beach et al.
2013/0023354 A1 1/2013 Sander et al.
2013/0035176 A1 2/2013 Burrows
2013/0053161 A1 2/2013 Moore
2013/0053164 A1 2/2013 Jertson et al.
2013/0053165 A1 2/2013 Jertson et al.
2013/0059676 A1 3/2013 Jertson et al.
2013/0085010 A1 4/2013 Beach et al.
2013/0102405 A1 4/2013 Moore
2013/0116062 A1 * 5/2013 Zimmerman et al. ..... 473/307
2013/0123038 A1 5/2013 Cole et al.
2013/0134251 A1 * 5/2013 Boyer et al. ..... 242/383.4
2013/0150175 A1 6/2013 Clausen et al.
2013/0178305 A1 7/2013 Beno et al.
2013/0178306 A1 7/2013 Beno et al.
2013/0184098 A1 7/2013 Boyd et al.
2013/0244805 A1 9/2013 Bolane et al.
2013/0296068 A1 11/2013 Sato
2013/0296069 A1 11/2013 Beach et al.
2013/0303300 A1 11/2013 Burnett et al.
2013/0316844 A1 11/2013 Sander et al.
2014/0066223 A1 3/2014 Beach et al.
2014/0087892 A1 3/2014 Beach et al.
2014/0221119 A1 8/2014 Aguinaldo et al.
2014/0248973 A1 9/2014 Murphy et al.
2014/0256461 A1 9/2014 Beach et al.
2014/0274445 A1 9/2014 Snyder
2014/0349778 A1 11/2014 Knutson et al.
2015/0018116 A1 1/2015 Zimmerman et al.
2015/0165279 A1 * 6/2015 Zimmerman et al.

* cited by examiner

GOLF CLUB ADJUSTABLE HOSEL ASSEMBLY

RELATED U.S. APPLICATION DATA

The present application is related to U.S. patent application Ser. No. 14/307,832, now U.S. Pat. No. 9,144,719, Ser. No. 14/307,874, now U.S. Pat. No. 9,144,720, and Ser. No. 14/307,911 entitled Golf Club Adjustable Hosel Assembly filed on the same day herewith, the full disclosure of which is hereby incorporated by reference.

FIELD OF THE INVENTION

The present invention relates generally to an adjustable hosel assembly for a golf club.

BACKGROUND OF THE INVENTION

Golf is a sport enjoyed by golfers of all ages and skill levels. Golfers at all levels continually strive to improve their game. One approach that many golfers use to improve their play is to customize their clubs to fit their game. Golf presents many challenges to golfers. For example, many golfers find their game changing over time. Additionally, golf courses present a variety of challenging holes that provide golfers the opportunity to use different clubs with different lofts or other characteristics to best meet such challenges. As a result, golfers require a variety of different clubs to meet these challenges.

Although golfers may desire a large number of different clubs for their game, many practical considerations can prevent golfers from meeting this need. The 14 club rule in the Rules of Golf limits the number of clubs golfers can carry. Players, who prefer to carry their bags, often prefer to limit the number of clubs they carry to make the round more enjoyable and carrying their golf bag less burdensome. Another consideration is cost. Although players may desire three different drivers having different characteristics, such as loft angles; many golfers simply can't justify the expense of purchasing such clubs.

One solution available to golfers today is the availability of golf clubs that can be adjusted or customized to meet the golfer's needs for a particular season, round or even shot. Many such golf clubs offer the ability for the golfer to disassemble and reassemble the golf club into a variety of different positions to obtain different club characteristics such as different loft angles, lie angle, face angles, etc. However, one significant drawback to such clubs is that many golfers find these clubs to be difficult and/or too complicated to use. Such clubs typically require the separation of the clubhead from the club shaft, and the use of one or more separate fasteners and tools to complete the disassembly and reassembly process. Once separated, the exposed components are susceptible to damage and the introduction of debris or moisture. Due to these issues, many golfers who use such clubs choose not to bother to adjust or optimize them even though the clubs are designed to be adjusted.

Thus, a continuing need exists for a golf club that can be easily, simply and conveniently adjusted to obtain different golf club characteristics. There is a need for a golf club that can be adjusted without risking the introduction of debris or moisture into the club head to shaft connection. What is needed is a golf club that performs well, and allows for the player to quickly and easily adjust the club head even during a round to match the golfer's particular needs or objectives at that time. There is a need for a club head that can be readily adjusted into a variety of different settings thereby eliminating the need for the golfer to carry multiple clubs to meet the different desired settings. Further, there is a need for a golf club that meets these needs while also providing an improved, pleasing aesthetic.

SUMMARY OF THE INVENTION

One example implementation of the present invention provides an adjustable assembly including a golf club shaft having a tip portion, a golf club head, a hosel insert, a shaft adapter, and a fastener. The golf club head includes a body having a crown, a sole, a striking plate and a hosel portion. The hosel portion defines an upper hosel opening. The hosel insert is secured to the hosel portion. The hosel insert includes a base element and at least one inwardly extending pawl having a distal end. The shaft adapter extends about a first longitudinal axis, and defines a shaft opening for engaging the tip portion of the shaft. The shaft adapter includes a plurality of outwardly projecting teeth aligned with the hosel insert. Each tooth includes a leading surface and a trailing surface. The leading surface is shaped to enable rotational movement of the shaft adapter about the first longitudinal axis with respect to the hosel insert in a first rotational direction. The trailing surface is shaped to selectively engage the distal end of the pawl to inhibit rotational movement of the shaft adapter with respect to the hosel insert in a second rotation direction that is opposite the first rotational direction. The fastener is releasably coupled to the club head and the shaft adapter, wherein the assembly is adjustable between a plurality of locked positions. Each of the plurality of locked positions defines at least one separate loft position, lie position, face angle position, or any combination thereof of the club head with respect to the shaft. The assembly is adjustable between the plurality of locked positions by loosening the fastener, rotating the shaft adapter in a first rotational direction without removing the plurality of teeth of the shaft adapter from the hosel insert, and tightening the fastener.

According to another example implementation of the present invention, a golf club shaft having a tip portion, a golf club head, a hosel insert, a shaft adapter and a fastener. The golf club head includes a body having a crown, a sole, a striking plate and a hosel portion. The hosel portion defines an upper hosel opening. The hosel insert is secured to the hosel portion. The hosel insert includes a base element and at least one inwardly extending pawl having a distal end. One of the hosel portion and the hosel insert includes a first set of upwardly extending projections. The shaft adapter extends about a first longitudinal axis. The shaft adapter defines a shaft opening for engaging the tip portion of the shaft. The shaft adapter includes a second set of outwardly projecting teeth aligned with the hosel insert and a third set of downwardly extending projections for selectable engagement with the first set of projections. Each tooth of the second set including a first leading surface and a first trailing surface. The first leading surface is shaped to enable rotational movement of the shaft adapter about the first longitudinal axis with respect to the hosel insert in a first rotational direction. The first trailing surface is shaped to selectively engage the distal end of the pawl to inhibit rotational movement of the shaft adapter with respect to the hosel insert in a second rotation direction, opposite the first rotational direction. The fastener is releasably coupled to the club head and the shaft adapter.

According to another example implementation of the present invention, an adjustable assembly includes a golf club shaft having a tip portion, a golf club head, a hosel insert, a shaft adapter and a fastener. The golf club head includes a body having a crown, a sole, a striking plate and a hosel portion. The hosel portion defines an upper hosel opening. The hosel insert is secured to the hosel portion and includes a plurality of inwardly projecting teeth. Each tooth includes a leading surface and a trailing surface. The shaft adapter extends about a first longitudinal axis, and defines a shaft opening for engaging the tip portion of the shaft. The shaft adapter includes at least one outwardly extending flexible or biased element having a distal end. The element is aligned with the teeth of the hosel insert. The leading surfaces of the teeth of the hosel insert are shaped to enable rotational movement of the shaft adapter about the first longitudinal axis with respect to the hosel insert in a first rotational direction. The trailing edge is shaped to selectively engage the distal end of the element to inhibit rotational movement of the shaft adapter with respect to the hosel insert in a second rotation direction, opposite the first rotational direction. The fastener is releasably coupled to the club head and the shaft adapter, wherein the assembly is adjustable between a plurality of locked positions. Each of the plurality of locked positions defines a separate loft position, lie position, face angle position, or any combination thereof of the club head with respect to the shaft, wherein the assembly is adjustable between the plurality of locked positions by loosening the fastener, rotating the shaft adapter in a first rotational direction without removing the plurality of teeth of the shaft adapter from the hosel insert, and tightening the fastener.

According to another example implementation of the present invention, an adjustable assembly includes a golf club shaft having a tip portion, a golf club head, a hosel insert, a shaft adapter and a fastener. The golf club head includes a body having a crown, a sole, a striking plate and a hosel portion. The hosel portion defines an upper hosel opening. The hosel insert is secured to the hosel portion and includes a first set of upwardly extending projections. The shaft adapter extends about a first longitudinal axis, and defines a shaft opening for engaging the tip portion of the shaft. The shaft adapter includes a second set of downwardly extending projections for selectable engagement with the first set of projections. The first and second sets of projections are shaped to enable rotational movement of the shaft adapter about the first longitudinal axis with respect to the hosel insert in a first rotational direction, and to inhibit rotational movement of the shaft adapter with respect to the hosel insert in a second rotation direction, opposite the first rotational direction.

DETAILED DESCRIPTION OF THE PREFERRED EMBODIMENTS

Figure 1:
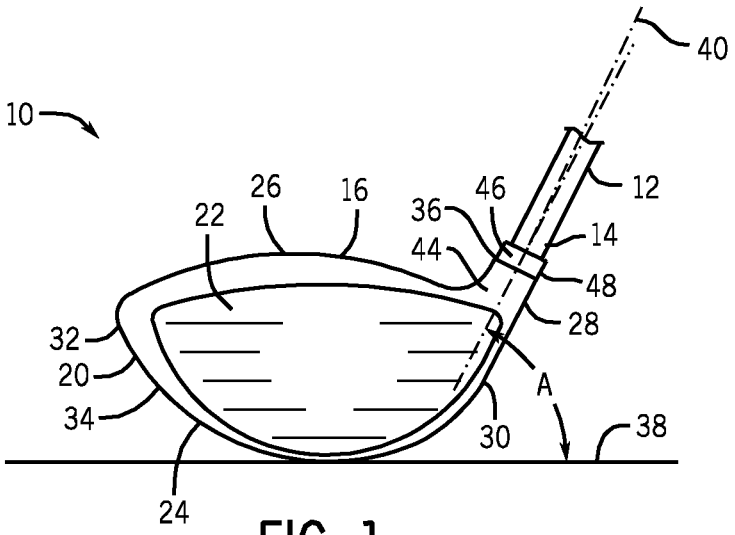
FIG. 1 is a front perspective view of a golf club with the club head on a ground plane in a square face address position in accordance with one example implementation of the present invention.
Figure 2:
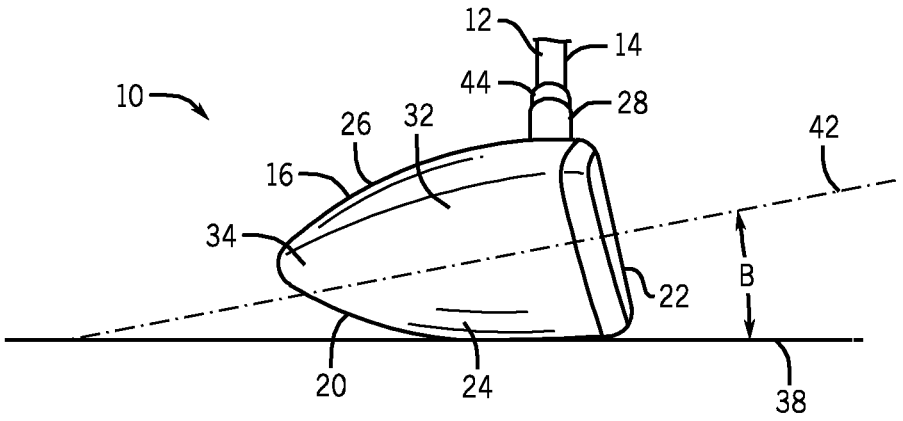
FIG. 2 is a side perspective of the golf club of FIG. 1.

Referring to FIGS. 1 and 2, a golf club is indicated generally at 10. The golf club 10 of FIG. 1 is configured as a driver. The present invention can also be formed as, and is directly applicable to, fairway woods, hybrids, irons, wedges, putters and combinations thereof in sets of golf clubs. The golf club 10 is an elongate implement configured for striking a golf ball and includes a golf shaft 12 having a butt end with a grip and a tip end 14 coupled to a club head 16.

Referring to FIGS. 1-3, the shaft 12 is an elongate hollow tube extending along a first longitudinal axis 18. The shaft 12 tapers toward the tip end 14. In one implementation, the tip end has an outside diameter of less than 0.400 inch. In other implementations, the outside diameter can be within the range of 0.335 to 0.370 inch. In example implementations, the outside diameter of the tip end 14 can be approximately 0.335 inch, 0.350 inch, 0.355 inch or 0.370 inch. The shaft 12 is formed of a lightweight, strong, flexible material, preferably as a composite material. In alternative embodiments, the shaft 12 can be formed of other materials such as, other composite materials, steel, other alloys, wood, ceramic, thermoset polymers, thermoplastic polymers, and combinations thereof. The shaft can be formed as one single integral piece or as a multi-sectional golf shaft of two or more portions or sections.

As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions with respect to the longitudinal axis 18, and/or in braids or weaves from layer to layer. The layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

The club head 16 includes a hollow body 20 that is coupled to the shaft 12. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another.

In one implementation, the club head 16 can be formed as a single unitary, integral body through a combination of casting and welding. In another implementation, the club head 10 can be formed through a combination of forging and welding. In other implementations, the components of the club head can be formed through casting, forging, welding, or a combination thereof. The body of the club head 16 includes a generally vertical front striking plate or strike face 22, a sole or sole plate 24, a crown 26 and a hosel portion 28. The striking plate 22 extends from a heel portion 30 to a toe portion 32 of the club head 10. The sole 24 and the crown 26 rearwardly extend from lower and upper portions of the striking plate 22, respectively. The sole 24 generally curves upward to meet the generally downward curved crown 26. The portion of the sole 24 adjacent the crown 26 that connects the sole 24 to the crown 26 at perimeter locations other than at the striking plate 22 can be referred to as a side wall 34 or skirt. The hosel portion 28 is a generally cylindrical body that upwardly extends from the crown 26 at the heel portion 30 of the club head 16 to couple the club head 16 to the shaft 12. The hosel portion 28 defines an upper hosel opening 36 for receiving the tip end 14 of the shaft 12. The hosel portion 28 also defines a hosel longitudinal axis 40. The hosel portion 28 can also include alphanumeric and/or graphical indicia 44. The indicia 44 can represent one or more alignment markings, trademarks, designs, model nos., club characteristics, instructional information, other information, and combinations thereof. The club head 16 is made of a high tensile strength, durable material, preferably a stainless steel or titanium alloy. Alternatively, the club head 10 can be made of other materials, such as, for example, a composite material, aluminum, other steels, metals, alloys, wood, ceramics or combinations thereof.

Referring to FIG. 1, the golf club 10 is shown on a ground plane 38 in a grounded address position. The golf club 10 has a lie position corresponds to a lie angle A defined as the angle between the hosel longitudinal axis 40 and the ground plane 38. In one implementation, the lie angle A is within the range of 50 to 66 degrees. Referring to FIG. 2, a toe portion view of the golf club 10 of FIG. 1 is shown. In the grounded address position, the loft position of the golf club 10 can be seen. The loft position corresponds to a loft angle B defined as the angle between a center striking plate normal vector 42 and the ground plane 38 when the head is in a square face address position. In one implementation, the loft angle B is within the range of 6 to 15 degrees. In another implementation, the loft angle B is within the range of 8.5 to 11.5 degrees. In yet another implementation, the loft angle B is within the range 9.0 to 12.0 degrees. In other implementations, the loft angle B can be up to approximately 64 degrees.

Figure 3A:
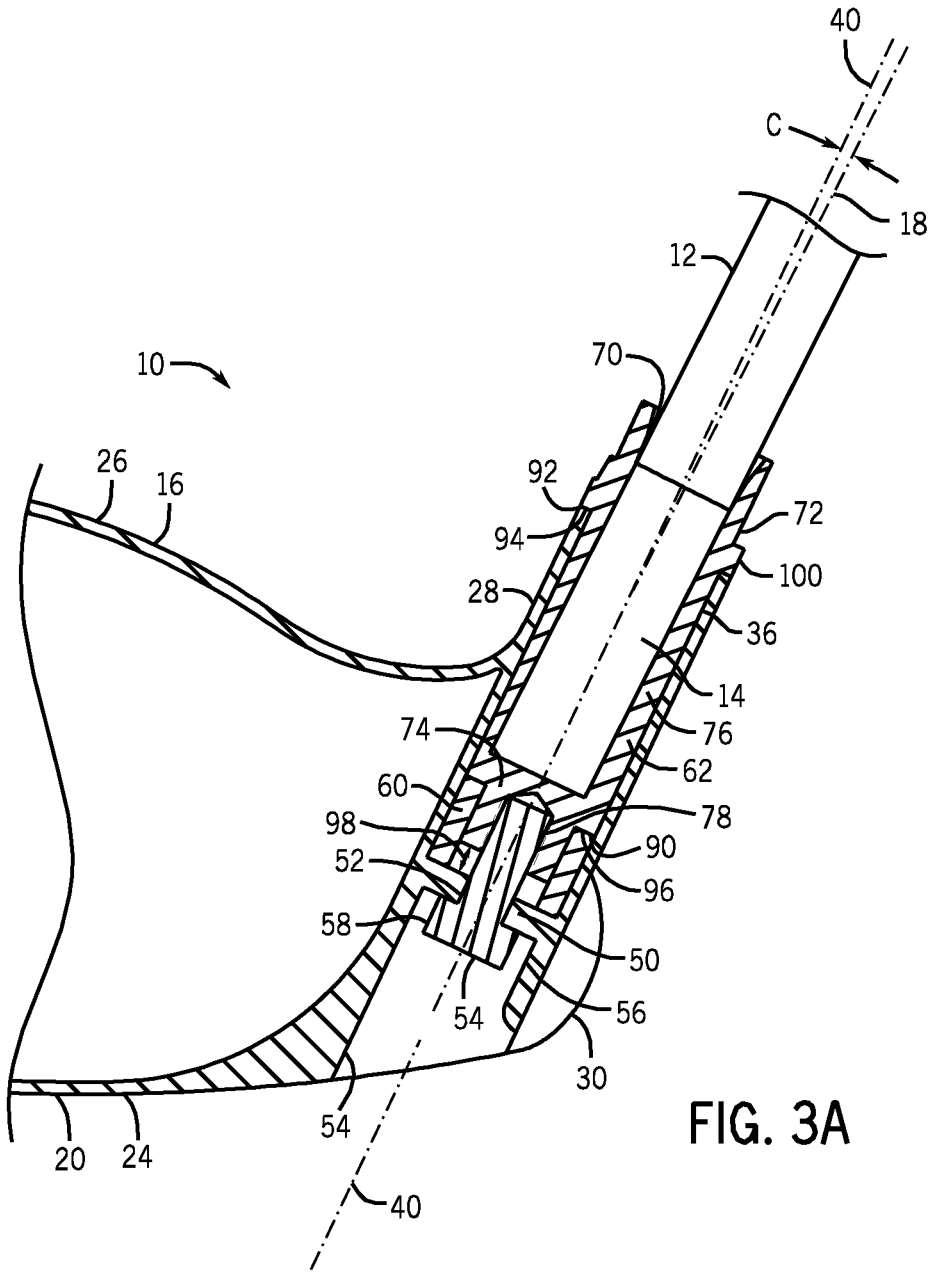
FIG. 3A is a front sectional view of the golf club head of FIG. 1.

Referring to FIG. 3A, the assembly of the shaft 12 to the club head 16 is shown in greater detail including the hosel portion 28. The hosel portion 28 includes a bottom wall 50 that defines the lower end of the upper hosel opening 36. In one implementation, the bottom wall 50 includes an aperture 52 for receiving a fastener 54. The club head 16 can also include a hosel recess 56 upwardly extending from the sole portion 24 of the heel portion 30 toward the bottom wall 50. In one implementation, the hosel recess 56 provides a space for receiving a head 58 of the fastener 54. In other implementations, the hosel recess 56 can have other configurations, can be sized and shaped to extend over one or more portions of the head 56 of the fastener 54, or can be eliminated altogether. In other implementations, the bottom wall 50 can be formed without the aperture 52, and other fastening locations can be utilized to couple the shaft 12 to the club head 16.

Referring to FIGS. 3A and 4 through 7, the golf club 10 includes an adjustable assembly for selectively adjusting certain characteristics of the golf club 10. The assembly includes a hosel insert 60, a shaft adapter 62 and the fastener 54. The hosel insert 60 is positioned within the upper hosel opening 36 and is coupled to the hosel portion 28. In one implementation, the hosel insert 60 includes a base element 64 and at least one pawl 66 extending from the base element 64 generally toward the hosel longitudinal axis 40. The base element 64 can be annular shaped support structure that is attached to the hosel portion 28 through an epoxy adhesive. In other implementations, the base element can be coupled to the hosel portion 28 through other fastening mechanisms, such as, for example, a press-fit connection, thermal bonding, chemical bonding, through one or more intermediate connecting members, and combinations thereof. In other implementations, the base element can be two more annular structures stacked or spaced apart from each other within the hosel opening 36 of the hosel portion 28. In other implementations, the base element can be two or more angularly or radially spaced apart members connected to the hosel portion and to the at least one pawl. In another implementation, the base element can be a single non-annular structure mounted to the hosel assembly for supporting the pawl. The pawl 66 can be an arm or tab having a proximal region that is formed to the base element 64 and a distal end 68. The pawl 66 is preferably formed of a resilient material, such as, for example, acrylonitrile butadiene styrene (ABS). In other implementations, the pawl 66 can be formed of other engineered thermoplastics, a fiber composite material, aluminum, other alloys, a thermoset material and combinations thereof.

The shaft adapter 62 is a sleeve for attachment to the tip end 14 of the shaft 12. The shaft adapter 62 is configured for operable engagement with the hosel insert 60 including selective adjustment of the shaft adapter 62 with respect to the hosel insert 60, and for removal attachment to the hosel portion 28 through one or more fasteners, such as, for example, the fastener 54. The shaft adapter 62 defines a shaft opening 70 for receiving the tip end 14. The shaft opening 70 can have a diameter corresponding to the tip diameter of the shaft 12. In one implementation, the shaft opening 70 has a diameter within the range of 0.325 to 0.560 inch. In another implementation, the diameter of the shaft opening 70 can be within the range of 0.370 to 0.500 inch. Referring to FIG. 3, in one implementation, the shaft opening 70 is aligned with the shaft axis 18. Accordingly, the orientation or shape of the shaft opening 70 aligns the shaft axis 18 in a preferred orientation that is angled with respect to the hosel axis 40 by an offset angle C. The offset angle can be within the range of 0.25 to 4.0 degrees. In other implementations, the offset angle C can be within the range of 0.5 to 2.0 degrees. The shaft adapter 62 is preferably formed of a strong, durable material such as aluminum. In other implementations, the shaft adapter can be formed of titanium, other alloys, wood, a composite material, a thermoplastic material, a thermoset material, and combinations thereof.

Referring to FIGS. 1, 3A, 5 and 6, the shaft adapter 62 includes upper and lower regions 72 and 74 separated by a central region 76. The shaft opening 70 can extend through the upper and central regions 72 and 76. In other implementations, the shaft opening 70 can extend only through the upper region. The lower region 74 preferably has a median outer diameter that is less than the outer diameter of the central region 72. In another implementation, the median outer diameter of the lower region 74 is less than the outer diameter of the central region 76 and the upper region 72. In one implementation, the lower region 74 can have an outer diameter of equal to or less than 0.350 inch. In one implementation, the lower region 74 has an outer diameter within the range of 0.270 to 0.400 inch. The outer diameter of the central region 76 can be within the range of 0.400 to 0.560 inch.

In one implementation, the lower region 74 defines a lower opening 78 for receiving the fastener 54. The lower opening 74 can be threaded to engage corresponding threads of the fastener 54. The lower opening 74 enables the fastener 54 to engage the lower region 74 of the shaft adapter 62 and fixedly secure the shaft adapter 62 to the hosel portion 28 of the club head 16. In other implementations, the lower opening can be two or more openings, or can take other configurations for engaging a fastener.

Figure 4:
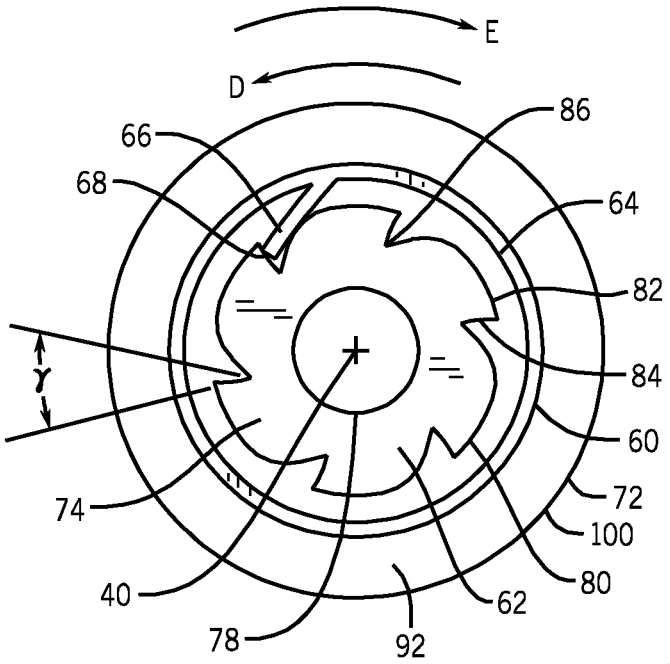
FIG. 4 is a bottom view of a shaft adapter and a hosel insert of a golf club in accordance with another example implementation of the present invention.

The lower region 74 can include a plurality of outwardly extending projections, such as, a set of outwardly projecting teeth 80. The teeth 80 are aligned with the hosel insert 60 when the shaft adapter 62 is fully inserted within the upper hosel opening 36 of the hosel portion 28. In one implementation, each of the teeth 80 is shaped to define a leading surface 82 (or leading face) and a trailing surface 84. The leading surface 82 is shaped to enable rotational movement of the shaft adapter 62 with respect to the hosel insert 60 in a first rotational direction D about the hosel axis 40. The trailing surface 84 is shaped to selectively engage the distal end 68 of the pawl 66 to inhibit rotational movement of the shaft adapter 62 with respect to the hosel insert 60 with respect to the hosel axis in a second rotational direction E. The second rotational direction E is opposite that of the first rotational direction D. Referring to FIG. 4, in one implementation, the first rotational direction D can be counter-clockwise about the hosel axis 40 when viewed from the bottom of the assembly, and the second rotational direction E can be clockwise. The leading surface 82 is provided with a gradual slope of within having a maximum slope of 5.67 or less. In another implementation, the leading surface has a maximum slope of 1.0 or less. The gradual maximum slope of the leading surface 82 is shaped and contoured to engage the distal end 68 of the pawl 66 and urge the pawl 66 over the leading surface 82 gradually when the shaft adapter 62 is rotating in the first rotational direction D with respect to the hosel insert 60. The pawl 66 is configured to be resilient so as to ride over the leading surface 82 during the rotational movement in the first rotational direction D.

The lower region 74 can have a smaller outer diameter because the tip end of the shaft 12 does not extend to the lower region 74 of the shaft adapter 62. Accordingly, structure for engaging the hosel insert 60, such as the teeth 80, can be advantageously placed onto the lower region 74 without increasing the maximum outer diameter of the shaft adapter 62. In one implementation, the ratio of the outer diameter of the central region 76 to the outer diameter of the lower region 74 is at least 1.2. In other implementations, the ratio of the outer diameters of the central region 76 to the lower region 74 is at least 1.3.

The trailing surface 84 is formed with a sharp abrupt change of slope, contour, or curvature to form a gullet 86 (also referred to as a catch). The transition of the leading surface 82 to the trailing surface 84 can be defined by a rake angle $\alpha$. When the trailing surface 84 extends along the radius of the shaft adapter 62, the rake angle $\alpha$ is 0 degrees. When the trailing surface 84 curves toward the axis 40 and back toward the leading surface 82 as shown in FIG. 4, the rake angle $\alpha$ is a positive value (e.g. positive 20 degrees). When the trailing surface slopes inward toward the axis 40 but not to the radial line of the shaft adapter 62, it takes a negative rake angle value. In one implementation, the rake angle $\alpha$ is 0 degrees+/−30 degrees. In other implementations, the rake angle $\alpha$ can take any value that results in a gullet 86 that engages the distal end 68 of the pawl 66 to prevent rotational movement of the tooth 80 in the second rotational direction E. The number of teeth 80 outwardly extending from the shaft adapter 62 can vary to meet the desired application. Referring to FIG. 4, the shaft adapter 62 has six teeth 80. Accordingly, the teeth 80 engage the distal end 68 of the pawl 66 in six discrete rotational positions of the shaft adapter 62 with respect to the hosel insert 60 about the hosel axis 60. In other implementations, the number of teeth 80 can be within the range of 2 to 16. In other implementations, the number of teeth 80 can be 3, 4, 5, 7, 8 or other values. In one implementation, the teeth 80 can take a form that resembles circular saw teeth. In other implementations, the teeth 80 can be replaced with another structure that allows for or enables rotation of the shaft adapter 62 with respect to the hosel insert 60 about the axis 40 in the first rotational direction D and inhibits rotation of the shaft adapter with respect to the hosel insert 60 in the second rotational direction E.

Figure 5:
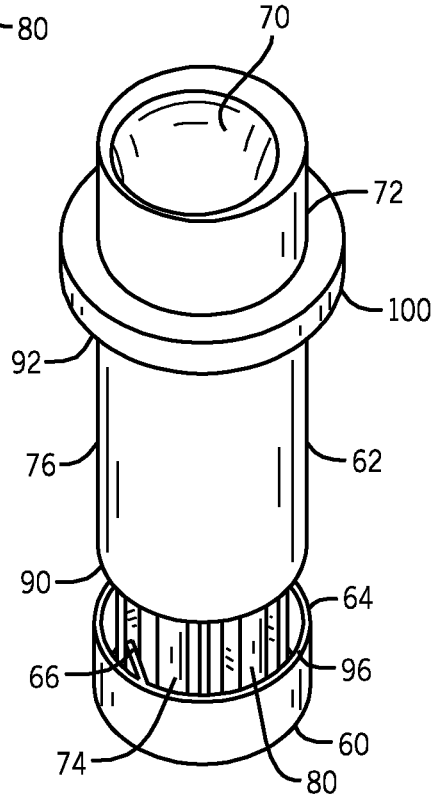
FIG. 5 is a top, side perspective view of the shaft adapter and the hosel insert of FIG. 4.
Figure 6:
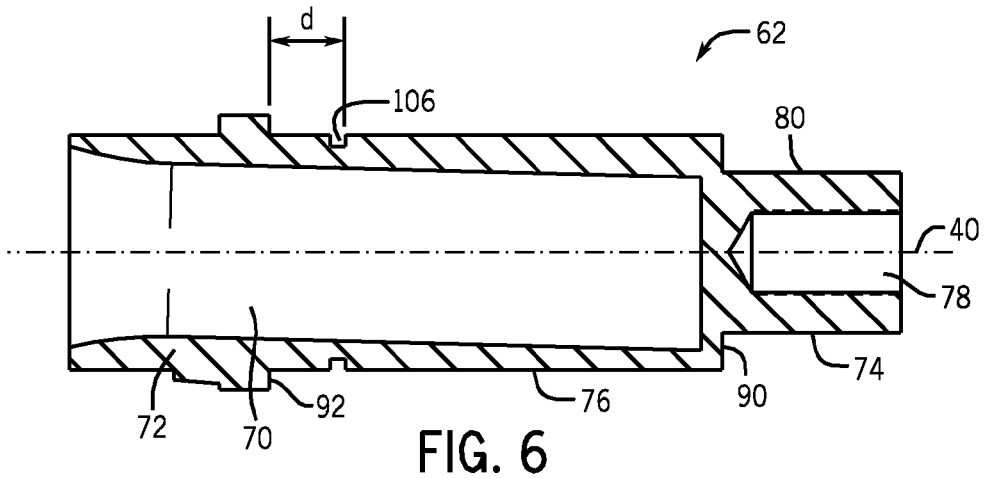
FIG. 6 is a longitudinal cross-sectional view of a shaft adapter of the golf club head of FIG. 3.

Referring to FIGS. 3A, 5 and 6, the upper region 72 of the shaft adapter can include first shoulder 90 at the transition of the central region 76 to the lower region 74 of the shaft adapter 62, and a second shoulder 92 for engaging an upper end 94 of the hosel portion 28. Referring to FIG. 3A, first shoulder 90 can contact or bear against an upper surface 96 of the hosel insert 60. The first shoulder 90 can be used to limit the insertion of the shaft adapter 62 within the hosel opening 36 of the hosel portion 28. The second shoulder can also be used limits the inward or downward travel of the shaft adapter 62 within the hosel opening 36. Accordingly, in one implementation engagement of the second shoulder 92 with the upper end 94 of the hosel portion 28 can limit insertion of the shaft adapter 62 into the hosel portion 28 and result in a gap 98 between the bottom surface of the shaft adapter 62 and the wall 50. In other implementations, the shaft adapter 62 can be configured so that the bottom surface of the shaft adapter engages the wall 50. In other implementations, the first shoulder 90 bearing against the upper surface 96 of the hosel insert 60 can be used to form the gap 98. In another implementation, the first and second shoulders 90 and 92 together can be used to limit the insertion of the shaft adapter 62 within the hosel portion 28 thereby forming the gap 98.

Figure 3B:
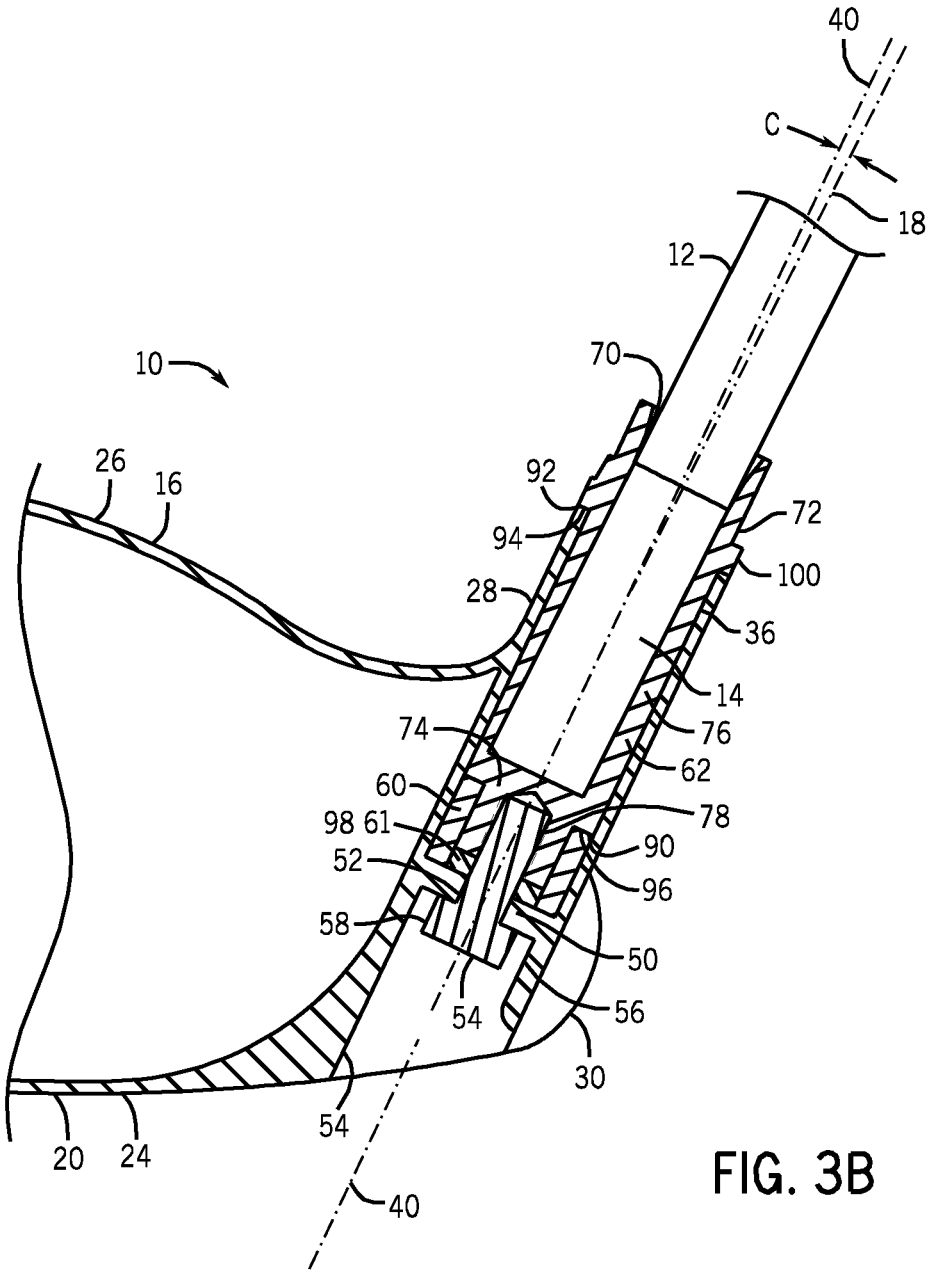
FIG. 3B is a front sectional view of the golf club head in accordance with another example implementation of the present invention.

Referring to FIG. 3B, in one implementation a retaining element 61 can be placed within the gap 98. The retaining element 61 can include an opening for receiving the fastener 54. The element 61 can be used to help retain the fastener 54 with the club head 10 when the fastener 54 is loosened. In other words, the retaining element 61 inhibits the fastener 54 from separating from, or falling off of, the club head 10 when the fastener 54 is loosened during adjustment of the club head to the shaft. The retaining element 61 is preferably a thin, flat member including the opening. The element 61 can be a gasket, a washer, a ring, an o-ring, or other intermediate elements. The element 61 can be used between the first shoulder 90 and the upper surface 96 of the hosel insert 60, and/or between the second shoulder 92 and the upper end 94 of the hosel portion 98. The distal end of the shaft adapter 62 can extend to and engage the retainer 61. In other implementations, the distal end of the shaft adapter 62 can be slightly spaced apart from the retainer 61.

The hosel insert 60 and the distal end of the pawl 66 have a hosel insert height and a pawl height, respectively, measured with respect to the hosel axis 40. In one implementation, the pawl height is within the range of 0.1 to 2.0 inches. In other implementations, the pawl height can be within the range of 0.3 to 0.6 inch. The teeth 80 have a tooth height measured with respect to the hosel axis 40. In one implementation, the teeth height is within the range of 0.1 to 0.8 inch. In other implementations, the teeth height can be within the range of 0.2 to 0.5 inch. In one particular implementation, the pawl height is approximately 0.425 inch and the tooth height is approximately 0.35 inch. In other implementations, other pawl height and tooth height dimensions can be used. The relative heights of the hosel insert 60 and the pawl 66 with respect to teeth 80 enable the pawl 66 and the teeth 80 to remain engaged during adjustment of the golf club 10 between the plurality of selectable locked positions. When the fastener 54 is loosened, the shaft adapter 62 can be rotated with respect to the hosel insert 60 in the first rotational direction D with the at least one pawl 66 in engagement with or aligned with the teeth 80. In other words, the shaft adapter 62 can be rotated between selectable positions relative to the hosel insert 60 and the club head 16 by simply loosening the fastener 54 and rotating the shaft adapter 62 with respect to the hosel insert 60 in the first rotational direction D without having to remove the at least one pawl 66 from alignment with or engagement with the gear teeth 80. In one implementation, at least 20 percent of pawl height of the at least one pawl 66 overlaps at least a portion of the teeth height of at least one of the teeth 80 during the rotational adjustment of the shaft adapter 62 with respect to the hosel insert 60 in the first rotational direction D about the hosel axis 40. The portion of the teeth height can be at least 20 percent or other value. In another implementation, at least 50 percent of pawl height of the at least one pawl 66 overlaps the teeth height of at least one of the teeth 80 during the rotational adjustment of the shaft adapter 62 with respect to the hosel insert 60 in the first rotational direction D about the hosel axis 40. The relative heights of the at least one pawl and the gear teeth can enable the shaft adapter 62 to be moved slightly, longitudinally upward with respect to the club head 16 during movement of the golf club 10 between the plurality of selectable positions while maintaining at least some engagement between the teeth 80 of the lower region 74 and the at least one pawl 66 of the hosel insert 60.

Figure 7:
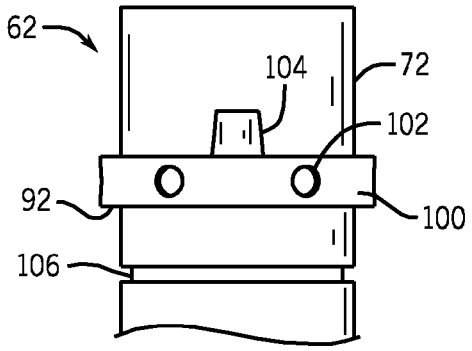
FIG. 7 is a side view of upper and central regions of the shaft adapter of FIG. 6.

Referring to FIG. 7, in one implementation, the second shoulder 92 can include an outer surface 100 that defines a plurality of recesses 102 and a tab 104. The recesses 102 can be configured as alignment markings. The recesses 102 can be used to indicate a plurality of discrete selectable positions of the shaft adapter 62 with respect to the hosel portion 28. In one implementation, the recesses 102 can correspond to the indicia 44. In other implementations, graphical and/or alphanumeric indicia can be positioned onto the outer surface 100 in combination with the recesses 102, or in lieu of the recesses. In another implementation, the recesses 102 can be replaced with one or more small projections, or a combination of projections and recesses. The tab 104 can be used for aligning the shaft 12 to the shaft adapter 62 or for aligning a ferrule 46 (FIG. 1) to the shaft adapter 62, the shaft 12 and/or the club head 16. In one implementation, the shaft adapter 62 and the hosel insert 60 are configured such that the at least one pawl 66 makes an audible sound, such as a clicking sound, when the pawl 66 transitions from the leading surface 82 to the trailing surface 84 of the gear teeth 80. The audible sound enables a user to readily adjust the club 10 from one selectable position to another of the plurality of selectable positions by listening to the number of clicks or sounds. For example, an adjustment of the golf club 10 from a first of the plurality of adjustable positions to a third of the plurality of adjustable positions can be accomplished by rotating the shaft adapter 62 relative to the hosel insert 62 in the first rotational direction D until two audible clicks are heard. The first click indicating the movement from the first to the second position, and the second click indicating the movement from the second to the third position.

Tables 1 through 11 illustrate example implementations in which the shaft adapter 62 and the hosel insert 60 define six selectable positions. Each selectable position 1 through 6 provides a unique loft, lie and face angle position of the golf club 10. In other implementations, other values for the loft positions and/or the lie positions can be used. In other implementations, other golf club characteristics such as face angle can be used in lieu of, or in addition to, lie position and loft position. In other implementations, the number of discrete selectable positions can be two, three, four, five, seven, eight or other number.

TABLE 1

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 8.5 | 9.0 | 9.5 | 10.5 | 11.0 | 11.5 |
| Face Angle (degrees) | +2.5 | +2.0 | +1.5 | +1.0 | +0.5 | 0.0 |

TABLE 2

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 12.5 | 13.0 | 13.5 | 14.5 | 15.0 | 15.5 |
| Face Angle (degrees) | +2.5 | +2.0 | +1.5 | +1.0 | +0.5 | 0.0 |

TABLE 3

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 14.0 | 14.5 | 15.0 | 16.0 | 16.5 | 17.0 |
| Face Angle (degrees) | +2.5 | +2.0 | +1.5 | +1.0 | +0.5 | 0.0 |

TABLE 4

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 16.0 | 16.5 | 17.0 | 18.0 | 18.5 | 19.0 |
| Face Angle (degrees) | +2.0 | +1.5 | +1.0 | +0.5 | 0.0 | −0.5 |

TABLE 5

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 16.0 | 17.0 | 18.0 | 16.0 | 17.0 | 18.0 |
| Face Angle (degrees) | +1.0 | +0.5 | 0.0 | +1.0 | +0.5 | 0.0 |
| Lie (Std./Up) | Std. | Std. | Std. | 2 Up | 2 Up | 2 Up |

TABLE 6

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 18.0 | 19.0 | 20.0 | 18.0 | 19.0 | 20.0 |
| Face Angle (degrees) | +1.0 | +0.5 | 0.0 | +1.0 | +0.5 | 0.0 |
| Lie (Std./Up) | Std. | Std. | Std. | 2 Up | 2 Up | 2 Up |

TABLE 7

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 20.0 | 21.0 | 22.0 | 20.0 | 21.0 | 22.0 |
| Face Angle (degrees) | +1.0 | +0.5 | 0.0 | +1.0 | +0.5 | 0.0 |
| Lie (Std./Up) | Std. | Std. | Std. | 2 Up | 2 Up | 2 Up |

TABLE 8

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 22.0 | 23.0 | 24.0 | 22.0 | 23.0 | 24.0 |
| Face Angle (degrees) | +1.0 | +0.5 | 0.0 | +1.0 | +0.5 | 0.0 |
| Lie (Std./Up) | Std. | Std. | Std. | 2 Up | 2 Up | 2 Up |

TABLE 9

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 8.0 | 8.5 | 9.0 | 9.5 | 10.0 | 10.5 |
| Face Angle (degrees) | +0.75 | +0.25 | 0.0 | −0.5 | −0.75 | −1.25 |
| Lie Angle (degrees) | 58.75 | 59.75 | 58.0 | 60.0 | 58.25 | 59.25 |

TABLE 10

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 9.5 | 10.0 | 10.5 | 11.0 | 11.5 | 12.0 |
| Face Angle (degrees) | +0.5 | 0.0 | −0.25 | −0.75 | −1.0 | −1.5 |
| Lie Angle (degrees) | 58.75 | 59.75 | 58.0 | 60.0 | 58.25 | 59.25 |

TABLE 11

| Separate Selectable Loft/Face Angle Positions | | | | | | |
|---|---|---|---|---|---|---|
| | Discrete Shaft Adapter Positions | | | | | |
| | 1 | 2 | 3 | 4 | 5 | 6 |
| Loft Angle (degrees) | 12.0 | 12.5 | 13.0 | 13.5 | 14.0 | 14.5 |
| Face Angle (degrees) | −0.25 | −0.75 | −1.0 | −1.5 | −1.75 | −2.25 |
| Lie Angle (degrees) | 58.75 | 59.75 | 58.0 | 60.0 | 58.25 | 59.25 |

Referring to FIG. 1, in one implementation, the ferrule 46 can be used to generally cover a portion of the upper region 72 of the shaft adapter 62 to improve the profile and general appearance of the club head to shaft connection. The ferrule 46 can be formed of any durable material, such as, a plastic. Alternatively, the ferrule can also be made of a composite material, aluminum, other alloys, an elastomeric material, a metal, a ceramic, wood and combinations thereof. The ferrule 46 can also include markings 48. The markings 48 can be alphanumeric and/or graphical indicia representing an alignment marking, a trademark, a design, a model no., a club characteristic, instructional information, other information, and combinations thereof.

Referring to FIG. 6, in one implementation, the central region 76 of the shaft adapter 62 can define a marker 106. The marker 106 is formed within or applied to the outer periphery of the central region 76 and is advantageously placed beneath the second shoulder 92 by a first predetermined distance d measured with respect to the hosel axis 40. In one implementation, the first predetermined distance d is approximately 0.150 inch. In other implementations, the first predetermined distance d can be within the range of 0.05 to 0.75 inch. In other implementations, the marker 106 can be replaced by a plurality of spaced apart notches or other recesses that define the first predetermined distance d.

In one implementation, the marker 106 can be a groove. In another implementation, the central region 76 may have one color, or one pattern of colors positioned at the first predetermined distance d, or at the area from the second shoulder 92 to the first predetermined distance d. In another implementation, a second color or second pattern of colors or symbols can be used on the central region 76 beyond or beneath the first predetermined distance d. In another implementation, the marker 106 can be a plurality of spaced apart recesses. In other implementations, the marker 106 can be an outwardly projecting ring or a plurality of spaced apart projections. In another implementation, the marker 106 can be or include graphical and/or alphanumeric indicia. In one implementation, the marker 106 can include indicia such as the word "stop" to indicate to the user that no further longitudinal movement of the shaft 12 and shaft adapter 62 is required for free rotational movement of the shaft adapter 62 with respect to the hosel insert 60 in the first rotational direction D. In other implementations, other forms of indicia can be used.

Figure 26:
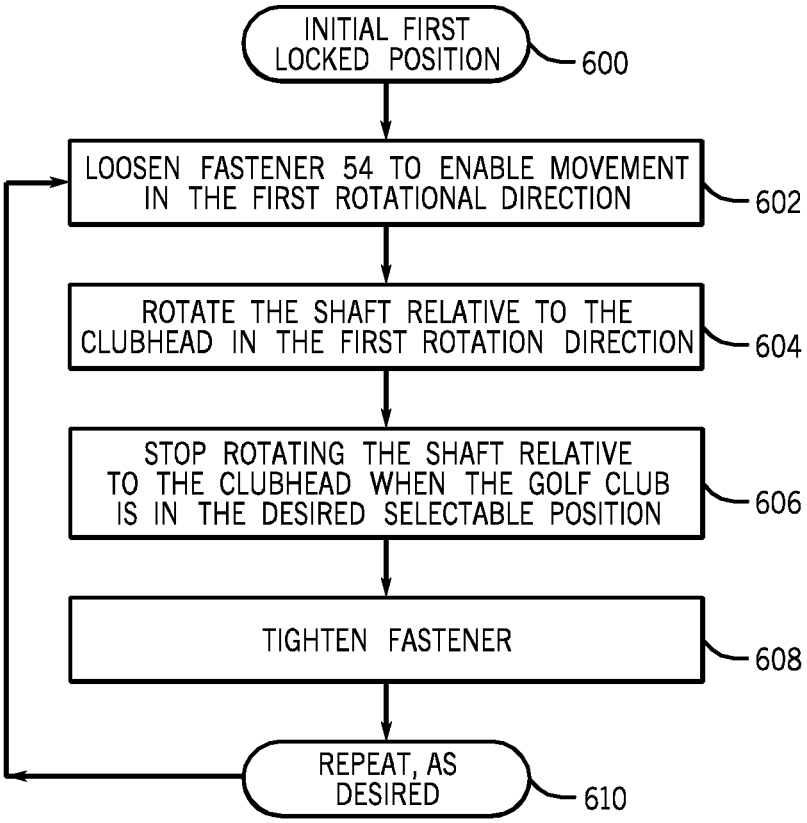
FIG. 26 is a flow diagram of an example method for adjusting the golf club of FIG. 1.

The adjustable assembly of the golf club 10 described above enables the shaft adapter to be selectively positioned in one of a plurality of selectable locked positions. Each of the locked positions defines a set of separate golf club characteristics. For example, each locked position can provide for a different lie and/or loft position. In other implementations, each locked position can provide different combinations of one or more of the following characteristics: lie position, loft position and face angle position. Referring to FIG. 26, a method of using the golf club 10 including the shaft adapter 62 and the hosel insert 60 (or 160, 260, 360 and 460) is illustrated. In step 600, the golf club 10 is in a first of a plurality of selectable locked positions, wherein the fastener 54 engages the hosel portion 28 of the club head 16 and the shaft adapter 62 to fixedly lock the club head 16 to the shaft 12. In step 602, the fastener 54 is loosened. In one implementation, the fastener 54 is loosened with a tool (not shown). The tool can be a torque wrench, a screw driver, other forms of wrenches or other fastening tools. In another implementation, the fastener can be configured to be loosened by hand. In one implementation, the fastener 54 is loosened to allow for rotational or relative movement of the shaft adapter 62 relative to the hosel insert 60 in the first rotational direction D, but without removing the fastener 54 from engagement with the shaft adapter 62. In step 604, the user can rotate the shaft 12 (and the shaft adapter 62) relative to the club head 16 (and the hosel insert 60) in the first rotational direction D about the hosel axis 40. In one implementation, as the pawl 66 travels over the leading surface 82 of the next gear tooth 80 and reaches the trailing surface 84, the pawl 66 will recoil and can make an audible clicking sound. The clicking sound can be used to indicate the movement from the first selectable position to the next selectable position. In another implementation, the user can observe the recesses 102 or other indicia or markings on the second shoulder 92 or indicia on the ferrule or on the shaft 12 relative to indicia 44 on the hosel portion 28 or other indicia or markings on the club head 16 to indicate when the next selectable position is reached. In another implementation, the user can use audible indication and visual indication to identify when the next selectable position is reached. In step 606, the user stops rotating the shaft 12 relative to the club head 16 in the first rotational direction D when the club head 16 is in the desired selectable position of the plurality of selectable positions. In step 608, the fastener 54 is tightened (or retightened) to fixedly lock the club head 16 to the shaft 12 in desired selectable locked position. In step 610, the user can repeat the steps of 602 through 608 to place the golf club 10 into another of the plurality of selectable locked positions. The above described method enables the user to easily, efficiently and effectively adjust the golf club 10 into one of a plurality of selectable locked positions, without having to remove the fastener 54 from the club head 14 or the shaft 12, and without having to remove the shaft adapter 62 from engagement with the hosel insert 60. The gear teeth 80 of the shaft adapter 62 do not have to be removed from engagement with the hosel insert 60 during selectable adjustment of the golf club 10. The shaft 12 does not have to be removed from the hosel portion 28 or the hosel insert 60 in order for the golf club to be adjusted between the plurality of selectable locked positions.

Figure 8:
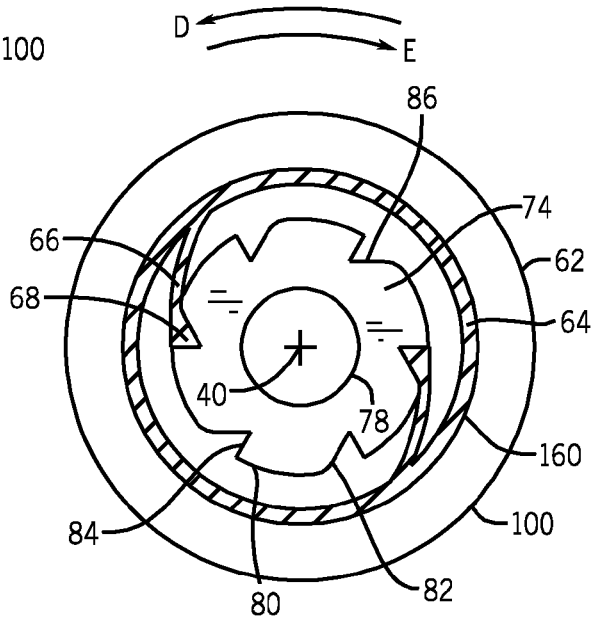
FIG. 8 is a bottom view of a shaft adapter and a hosel insert of a golf club in accordance with another example implementation of the present invention.
Figure 9:
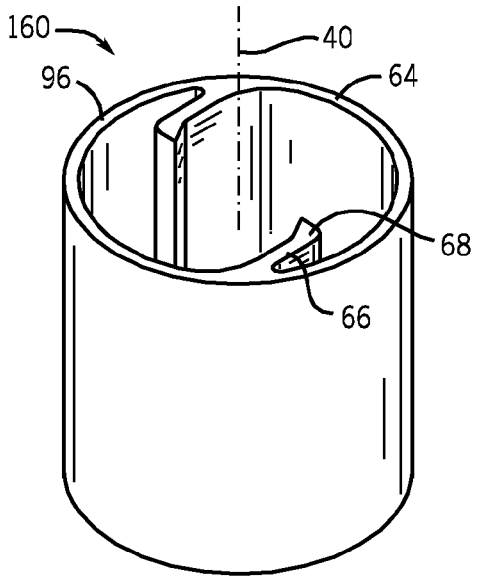
FIGS. 9 through 12 are upper, side perspective views of hosel inserts for a golf club head in accordance with other example implementations of the present invention.

Referring to FIGS. 8 and 9, another implementation of a hosel insert is illustrated as item 160. The hosel insert 160 is substantially the same as hosel insert 60 described above, with exception of the pawls 66. The hosel insert 160 includes two spaced apart pawls 66 inwardly extending from the base element 64. Each pawl 66 is configured to operably and selectively engage separate teeth 80 of the shaft adapter 62 as the shaft adapter 62 is rotated in the first rotational direction D. The distal ends 68 of the pawls 66 are configured to enable rotational movement of the teeth 80 in the first rotational direction D. The distal ends 68 of the pawls 66 are configured to inhibit rotational movement of the teeth 80 in the second rotational direction E. The two pawls 66 can be angularly spaced apart from each other with respect to the hosel axis 40 by approximately 180 degrees. The two pawls 66 lessen the loading and/or stresses, including torsional loads or stresses, applied to the pawls 66 during use and adjustment. The two pawls 66 also assist in centering or balancing the adjustable assembly of the golf club 10. The distal end 68 of the pawls 66 can be enlarged to better conform or correspond to the shape of the gear teeth 80 including the shape of the gullets 86 formed by the gear teeth 80. In other implementations, the distal ends of the pawls 66 can take other shapes to correspond or efficiently operate with the gear teeth 80 of the shaft adapter 62.

Figure 10:
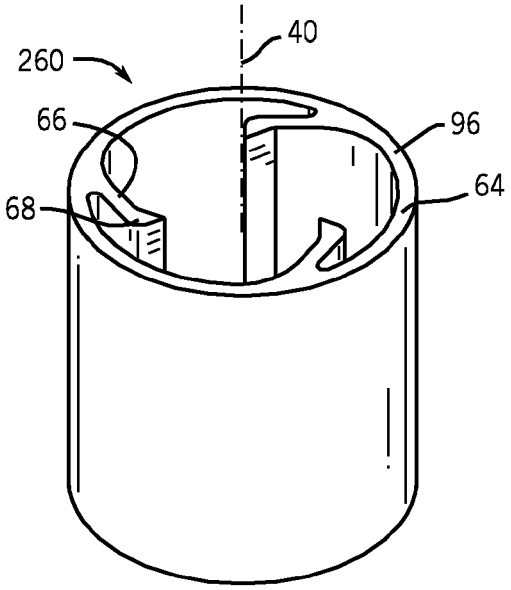
Figure 11:
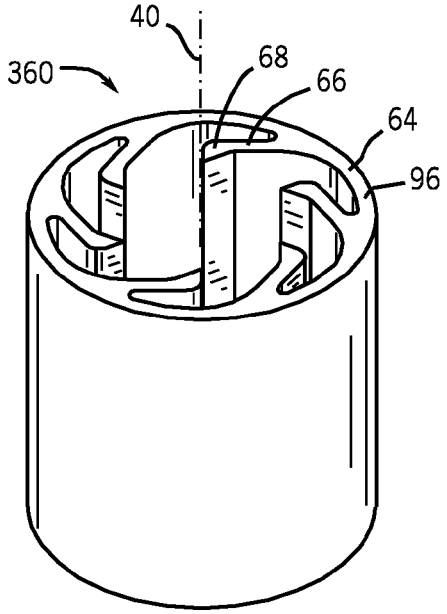

Referring to FIGS. 10 and 11, two other implementations of the hosel insert 60 are illustrated as hosel inserts 260 and 360, respectively. The hosel inserts 260 and 360 are substantially the same as the hosel inserts 60 and 160 above, except for the number of pawls 66. The hosel insert 260 includes three spaced apart pawls, and the hosel insert 360 includes six spaced apart pawls. Each pawl 66 is configured to operably and selectively engage separate teeth 80 of the shaft adapter 62 as the shaft adapter 62 is rotated in the first rotational direction D, enabling rotation in the first rotational direction D. The distal ends 68 of the pawls 66 are configured to inhibit rotational movement of the teeth 80 in the second rotational direction E. The three pawls 66 can be angularly spaced apart from each other with respect to the hosel axis 40 by approximately 120 degrees, and the six pawls can be spaced apart from each other with respect to the hosel axis 40 by approximately 60 degrees. The three or six pawls 66 further lessen the loading and/or stresses, including torsional loads or stresses, applied to the pawls 66 during use and adjustment. The three or six pawls 66 also assist in centering or balancing the adjustable assembly of the golf club 10. In other implementations, the hosel insert can be formed with other numbers of pawls, and the pawls can have different shapes and contours.

Figure 12:
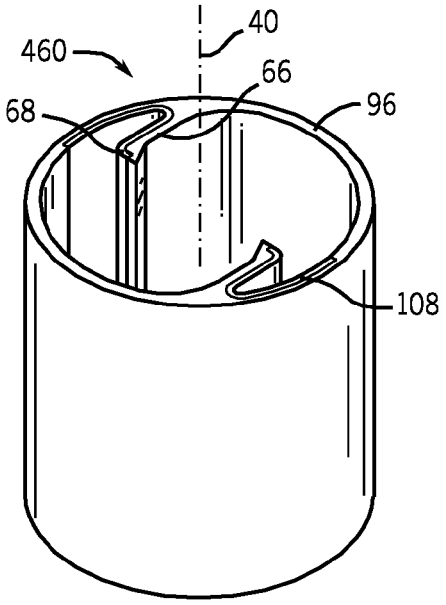

Referring to FIG. 12, another implementation of a hosel insert is illustrated as item 460. The hosel insert 460 is substantially the same as hosel inserts 60, 160, 260 and 360 described above, with exception of the pawls 66. Each pawl 66 includes a curved flat spring 108 or a bar spring for facilitating the resilient deflection of the pawl 66 as the distal end 68 of the pawl 66 operably engages the gear teeth 80 during rotation of the shaft adapter 62 in the first rotational direction D. The spring 108 urges or biases the distal end 68 of the pawl 66 inward into the gullets 86 of the gear teeth 80 such that the distal end 68 of the pawl 66 inhibits rotation of the shaft adapter 62 with respect to the hosel insert 60 about the hosel axis 40 in the second rotational direction E. The hosel insert 460 includes two spaced apart pawls 66 inwardly extending from the base element 64. However, in other implementations, other numbers of pawls can also be used. The two pawls 66 can be angularly spaced apart from each other with respect to the hosel axis 40 by approximately 180 degrees. In other implementations, other spring configurations can be used in association with the one or more pawls.

Figure 13:
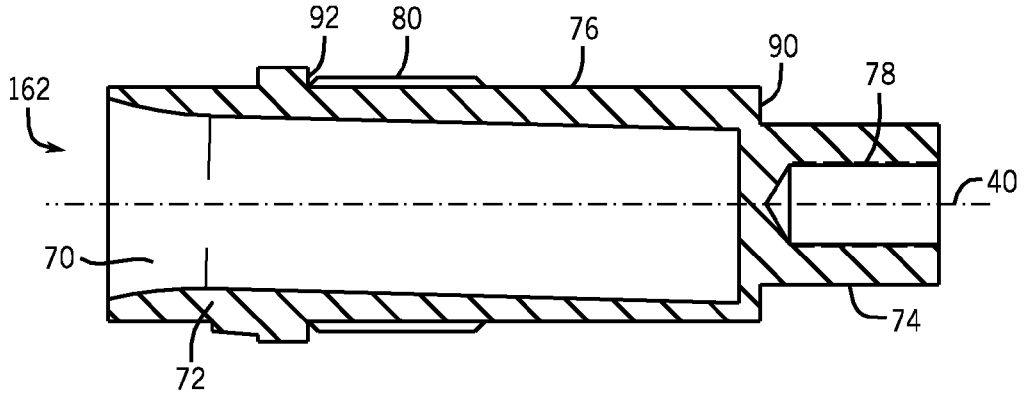
FIGS. 13 and 14 are longitudinal cross-sectional views of shaft adapters of a golf club in accordance with other example implementations of the present invention.
Figure 14:
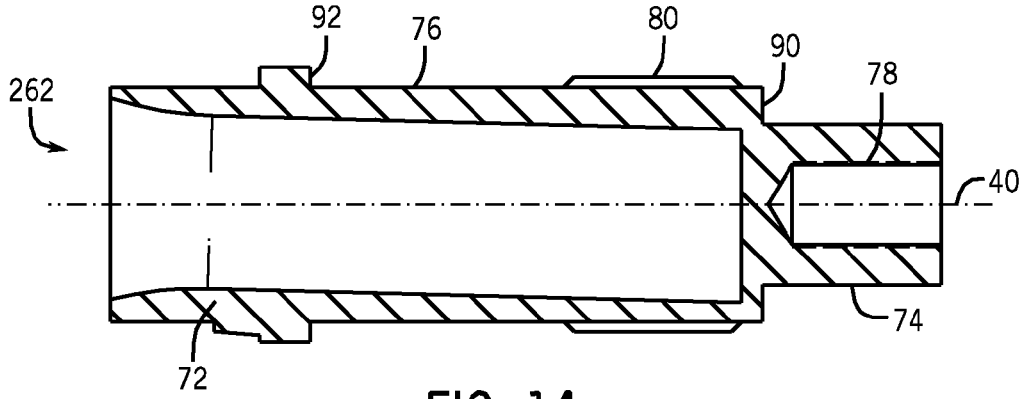
Figure 15:
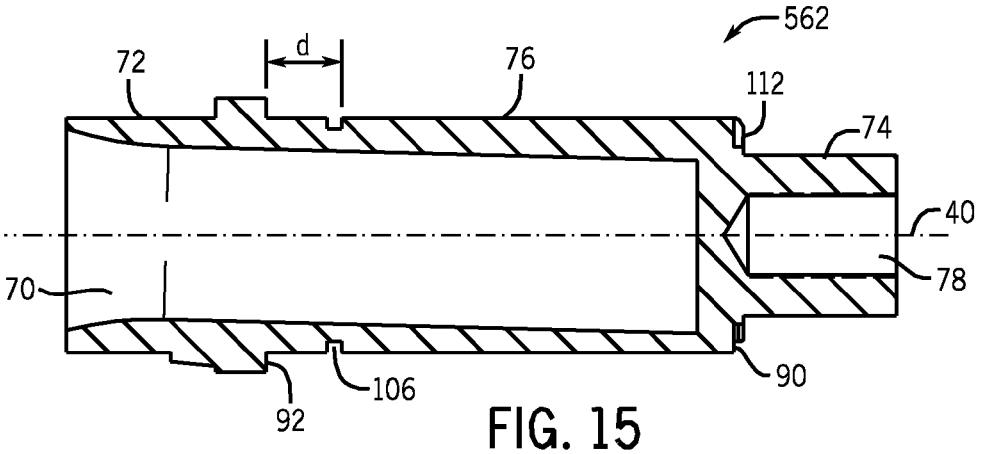
FIG. 15 is a longitudinal cross-sectional view of a shaft adapter for a golf club in accordance with another example implementation of the present invention.
Figure 16:
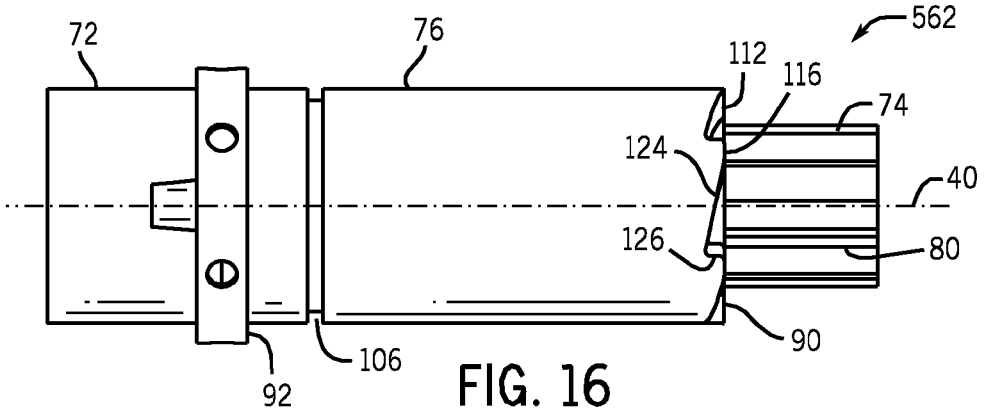
FIG. 16 is a side view of the shaft adapter of FIG. 15.
Figure 17:
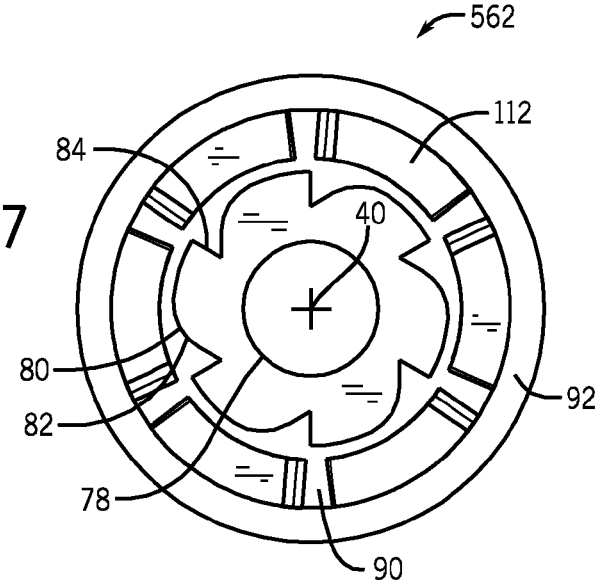
FIG. 17 is a bottom view of the shaft adapter of FIG. 15.
Figure 18:
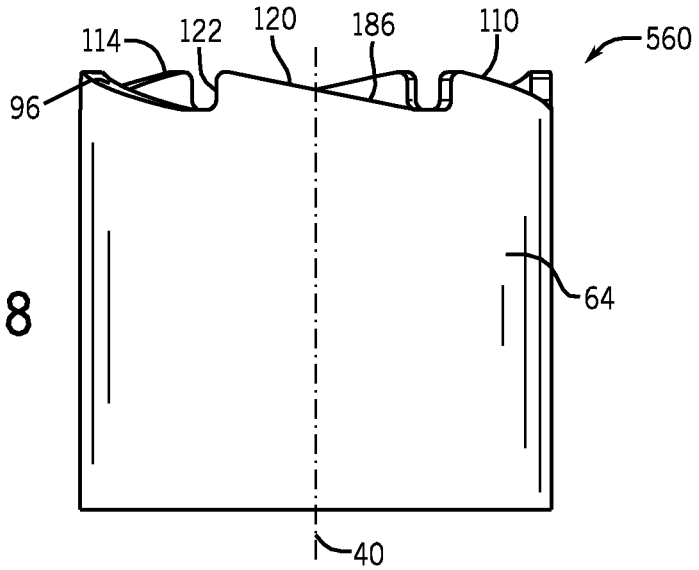
FIG. 18 is a side view of a hosel insert for engagement with the shaft adapter of FIG. 15.
Figure 19:
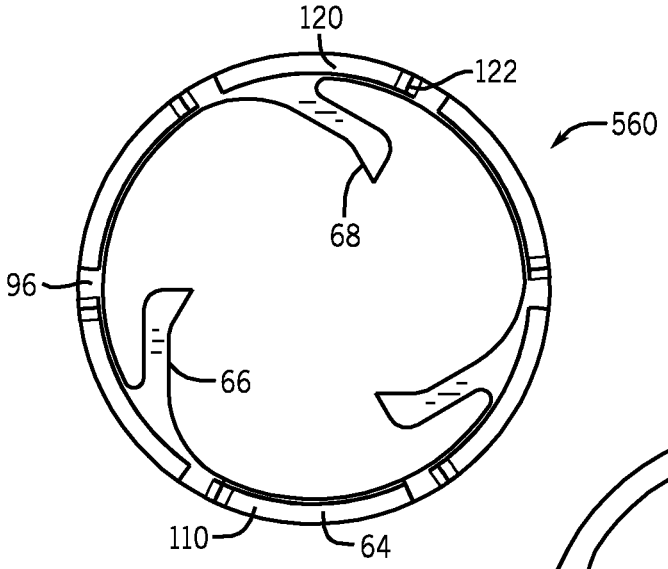
FIG. 19 is a top view of the hosel insert of FIG. 18.
Figure 20:
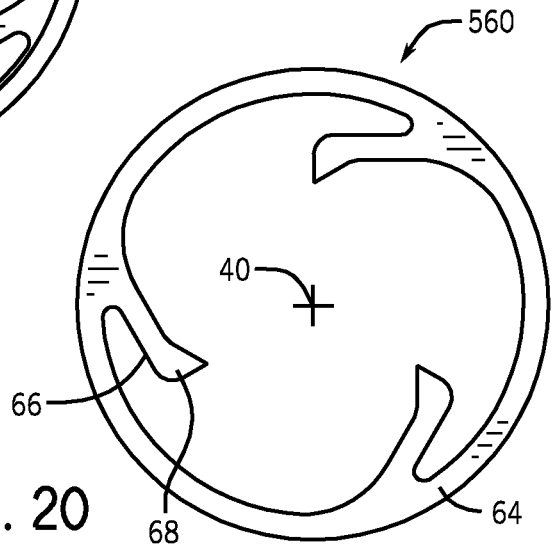
FIG. 20 is a bottom view of the hosel insert of FIG. 18.

Referring to FIGS. 13 and 14, alternative implementations of the shaft adapter are illustrated as items 162 and 262. The shaft adapters 162 and 262 are substantially the same as the shaft adapter 62 described above, with the exception of the gear teeth 80. The gear teeth 80 can be positioned on other locations about the shaft adapter. In FIG. 13, the gear teeth 80 outwardly extend from the upper part of the central region 76 of the shaft adapter 162. In FIG. 14, the gear teeth outwardly extend from the lower part of the central region 76 of the shaft adapter 262. The hosel insert to be used in association with the shaft adapter 162 and 262 would be necessarily larger in diameter than the hosel insert 60 to account for the increased diameter of the central region 76 of the shaft adapters 162 and 262. The hosel insert would also be positioned within and attached to the hosel portion 28 of the club head 16 to correspond to the location of the gear teeth 80. In other implementations, the gear teeth 80 can extend along the entire height of the central region of the shaft adapter measured with respect to the hosel axis 40, be centered along the central region, be positioned on the upper region, or in any other location about the shaft adapter.

Referring to FIGS. 15 through 20, an alternative implementation of the adjustable assembly of the golf club 10 is illustrated. The adjustable assembly includes a hosel insert 560 and a shaft adapter 562, which are substantially the same as the hosel inserts 60, 160, 260 and 360 and the shaft adapter 62 discussed above, except for the configuration of the first shoulder 90 and the upper surface 96. The upper surface 96 of the hosel insert 560 includes insert structure 110 configured to selectively engage adapter structure 112 included on the first shoulder 90 of the shaft adapter 562. The insert structure 110 and the adapter structure 112 can be a plurality of projections and recesses shaped and sized to matably and operably engage each other. In one implementation, the insert structure 110 and the adapter structure 112 are shaped and sized to enable relative movement of the first shoulder 90 and the upper surface 96 in the first rotational direction D, and inhibit relative movement of the first shoulder 90 and the upper surface 96 in the second rotational direction E.

The insert structure 110 can be a first set of upwardly extending projections 114. The adapter structure 112 of the first shoulder 90 of the shaft adapter 562 can be a third set of downwardly extending projections 116 configured for selectable engagement with the first set of projections 114. In one implementation, the insert structure 110 and the adapter structure 112 can be gear teeth. The gear teeth of the insert structure 110 can include a leading surface 120 and a trailing surface 122, and the gear teeth of the adapter structure 112 can include a leading surface 124 and a trailing surface 126. In one implementation, the leading and trailing surfaces 120 and 122 of the insert structure 110 can be mirror images of leading and trailing surfaces 124 and 126 of the adapter structure 112. The leading surfaces 120 and 124 can have a gradual slope, and the trailing surfaces 122 and 126 can have an abrupt slope such that gullets 186 are formed by the leading and trailing surfaces. In other implementations, the insert structure 110 and the adapter structure 112 can have other forms of gear teeth, or other forms of corresponding structure. In one implementation, the insert and adapter structure 110 and 112 can be configured for facilitating the initial positioning of the shaft adapter 262 within the hosel insert 260. In another implementation, the insert and adaptive structure 110 and 112 can be configured for facilitating the selective indexing or discrete rotational positioning of the shaft adapter 262 with respect to the hosel insert 260. In another implementation, the insert and adapter structure 110 and 112 can be configured for facilitating centering, facilitating rotational positioning in the first rotational direction D while inhibiting rotational movement in the second rotational direction E. In another implementation, one of the insert structure 110 and the adaptive structure 112 can include at least one secondary pawl configured to engage the other of the insert structure 110 and the adaptive structure 112.

Similar to the shaft adapter 62, the central region 76 of the shaft adapter 562 also can define a marker 106. The marker 106 is formed within the outer periphery of the central region 76 and is advantageously placed beneath the second shoulder 92 by a first predetermined distance d measured with respect to the hosel axis 40. In other implementations, other forms of markers or markings can be used in lieu of or in addition to the groove. The distance d provides an indication to the user of when the shaft adapter 562 is sufficiently longitudinally moved away from the hosel portion 36 of the club head 16 so as to allow the shaft adapter structure 112 to disengage from the hosel insert structure 114 while at least a portion of one of the pawls 66 of the hosel insert 560 remains engaged to the teeth 80 of the lower region 74 of the shaft adapter 562. When the shaft adapter 562 is longitudinally moved to the distance d, the shaft adapter 562 is free to rotate in the first rotational direction D with respect to the hosel insert 560 for easy adjustment between the plurality of selectable positions. In one implementation, the first predetermined distance d is approximately the same as the height of the adapter structure 112 measured with respect to the longitudinal axis 40. In another implementation, the distance d is equal to or larger than the height of the adapter structure 112.

The insert structure 110 and adapter structure 112 provide at least two important benefits to the golf club 10. The insert structure 110 and adapter structure 112 provide additional support to the adjustable assembly including torsional support. When the shaft adapter 562 is fixedly secured to the hosel insert 560 and the hosel portion 28, the insert structure 110 and the adapter structure 112 provide additional bearing surfaces enable the golf club 10 to retain its torsional stability even upon impact with a golf ball. Additionally, during selectable adjustment of the shaft adapter 562 relative to the hosel insert 560, the insert structure 110 and adapter structure 112 can provide additional or redundant indexing and/or discrete positioning mechanism for identifying when the club head 16 is repositioned relative to the shaft 12 into one of the selectable locked positions.

Figure 27:
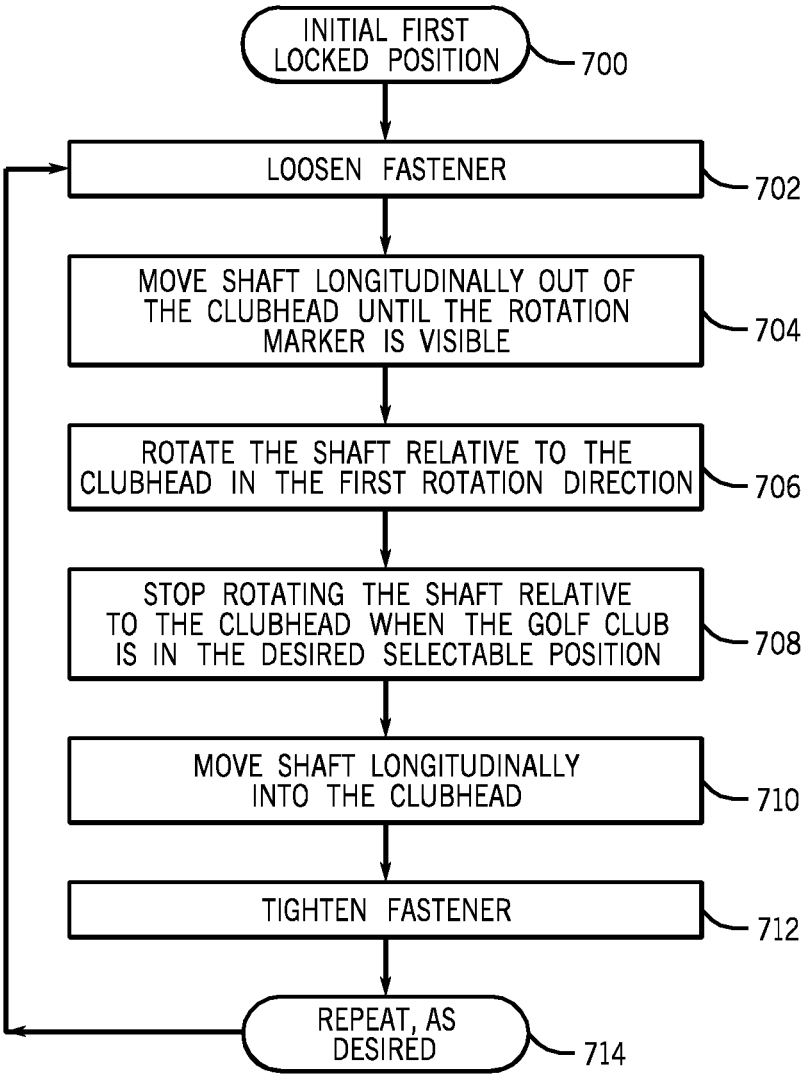
FIG. 27 is a flow diagram of an example method for adjusting the golf club with the shaft adapter of FIG. 15.

The adjustable assembly of the golf club 10 described above enables the shaft adapter 562 to be selectively positioned in one of a plurality of selectable locked positions relative to the hosel insert 560. Each of the locked positions defines a set of separate golf club characteristics. Referring to FIG. 27, a method of using the golf club 10 including the shaft adapter 562 and the hosel insert 560 is illustrated. In step 700, the golf club 10 is in a first of a plurality of selectable locked positions, wherein the fastener 54 engages the hosel portion 28 of the club head 16 and the shaft adapter 562 to fixedly lock the club head 16 to the shaft 12. In step 702, the fastener 54 is loosened, similar to step 602 described above. In step 704, the shaft 12 (and the shaft adapter 562) can be moved longitudinally from the hosel portion 28 of the club head 16 by the first predetermined distance d until the marker 106 is visible on the shaft adapter 562. In this position, the gear teeth 80 of the shaft adapter 562 remain in engagement with the at least one pawl 66 of the hosel insert 560. In one implementation, at least 20 percent of the at least one pawl 66 remains engaged with at least a portion of the gear teeth 80. In one implementation, the predetermined distance d is sized to provide general separation of the insert structure 110 from the adapter structure 112. In step 706, the user can rotate the shaft 12 (and the shaft adapter 562) relative to the club head 16 (and the hosel insert 560) in the first rotational direction D about the hosel axis 40. In step 708, the user can stop rotating the shaft 12 relative to the club head 16 in the first rotational direction D, when the club head 16 is in the desired selectable position of the plurality of selectable positions, as indicated by visual and/or audible indications as described above. In step 710, the shaft 12 can be moved longitudinally into the club head 16. In one implementation, the shaft 12 is moved longitudinally toward the club head 16 such that the insert structure 110 fully engages the adapter structure 112. In step 712, the fastener 54 is tightened (or retightened) to fixedly lock the club head 16 to the shaft 12 in desired selectable locked position. In step 714, the user can repeat the steps of 702 through 712 to place the golf club 10 into another of the plurality of selectable locked positions.

The above described method enables the user to easily, efficiently and effectively adjust the golf club 10 into one of a plurality of selectable locked positions, without having to remove the fastener 54 from the club head 14 or the shaft 12, and without having to remove the shaft adapter 562 from engagement with the hosel insert 560. The gear teeth 80 of the shaft adapter 562 do not have to be removed from engagement with the hosel insert 560 during selectable adjustment of the golf club 10. The shaft 12 does not have to be removed from the hosel portion 28 or the hosel insert 560 in order for the golf club to be adjusted between the plurality of selectable locked positions.

Figure 21:
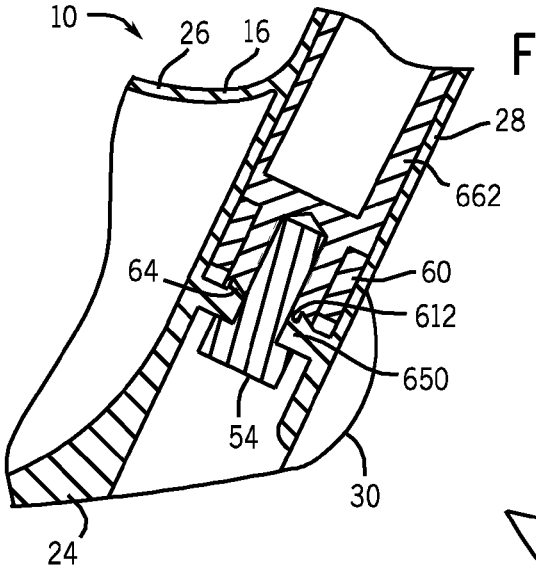
FIG. 21 is a front sectional view of an adjustable assembly of a golf club in accordance with another example implementation of the present invention.
Figure 22A:
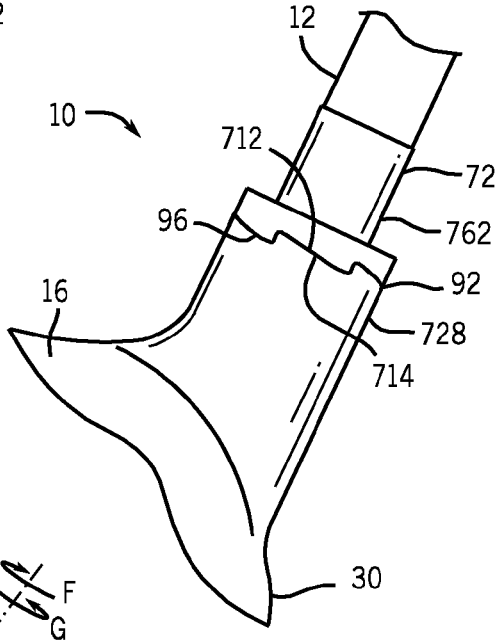
FIG. 22A is a front view of an adjustable assembly of a golf club in accordance with another example implementation of the present invention.
Figure 22B:
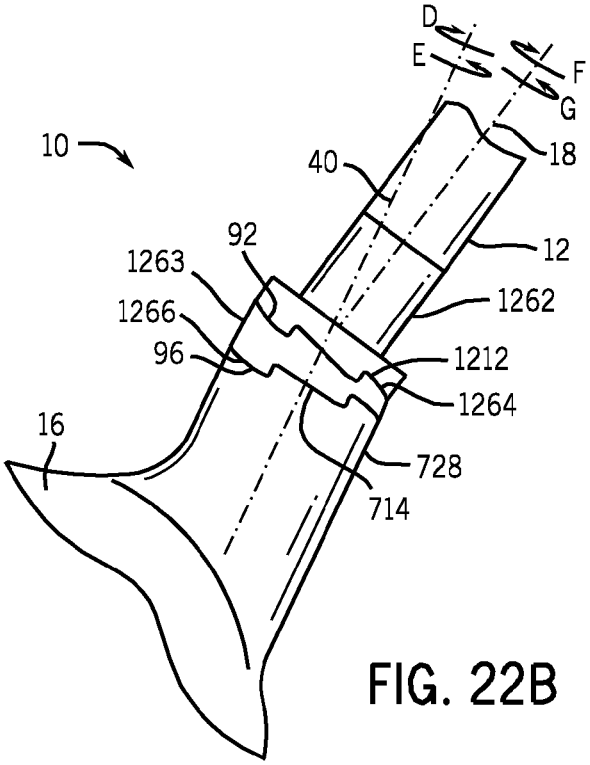
FIG. 22B is a front view of an adjustable assembly of a golf club in accordance with another example implementation of the present invention.

Referring to FIGS. 21, 22A and 22B, alternative implementations of the adjustable assembly of the golf club 10 are illustrated. In FIG. 21, the assembly is substantially similar to the previously described assemblies, with the exception of the shaft adapter and the bottom wall of the hosel portion. A shaft adapter 662 is similar to the shaft adapter 62 however, the lower surface of the lower region 74 of the shaft adapter 662 includes downwardly extending adapter structure 612, and a bottom wall 650 of the hosel portion 28 includes upwardly extending hosel structure 614. The adapter structure 612 is substantially similar to the adapter structure 112 described above except that it is configured to engage the hosel structure 614. The hosel structure 614 is similar to the insert structure 110 describe above except that it is formed in the bottom wall 650 of the hosel portion 28. Similar to the structures 110 and 112 described above, the structures 612 and 614 can be gear teeth or other structure, and they provide the at least two important advantages to the adjustable assembly of improved torsional stability and facilitate indexing or selective adjustment. In another implementation, the hosel structure 614 can be formed by a washer that is inserted into the hosel portion 28 over the bottom wall 50.

Referring to FIG. 22A, the assembly is substantially similar to the previously described assemblies, with the exception of the shaft adapter and the upper end of the hosel portion. A shaft adapter 762 is similar to the shaft adapter 62 however, the second shoulder 92 of the shaft adapter 762 includes downwardly extending adapter structure 712, and the upper end 96 of the hosel portion 728 includes upwardly extending hosel structure 714. The adapter structure 712 is substantially similar to the adapter structure 112 described above except that it is configured to engage the hosel structure 714. The hosel structure 714 is similar to the insert structure 110 and hosel structure 614 described above except that it is formed in the upper end 96 of the hosel portion 28. Similar to the structures 110 and 112 described above, the structures 112 and 114 can be gear teeth or other structure, and they provide the at least two important advantages to the adjustable assembly of improved torsional stability and redundant indexing or selective adjustment.

Referring to FIG. 22B, another alternative implementation of the present invention is illustrated. The adjustable assembly for the golf club 10 is substantially similar to the implementation of FIG. 22A, with the exception of an angled member 1263 positioned between an upper end 96 of the hosel portion 728, and the second shoulder 92 of a shaft adapter 1262. The angled member 1263 is an annular structure having a top and bottom surfaces 1264 and 1266. The angled member 1263 also has a height measured with respect to the axis 40 that varies about its circumference such that the member 1263 defines an angle 13 with respect to the top and bottom surfaces 1264 and 1266. The top and bottom surfaces 1264 and 1266 each include structure for facilitating movement in one rotational direction and inhibiting rotational movement is a second rotational direction, opposite the first.

The shaft adapter 1262 is similar to the shaft adapters 62 and 762. The second shoulder 92 of the shaft adapter 1262 includes downwardly extending adapter structure 1212 configured to engage upwardly extending structure of the top surface 1264 of the angled member 1263. The upper end 96 of the hosel portion 728 includes upwardly extending the hosel structure 714. The adapter structure 1212 is substantially similar to the adapter structures 112 and 712 described above. The hosel structure 714 is configured to engage the bottom surface 1266 of the angled member 1263. The structure of the bottom surface 1266 of the angled member 1263 and the hosel structure 714 are configured to engage each other and to allow for rotation of the angled member 1263, and the shaft adapter 1262 relative to the hosel insert in the first rotational direction D about axis 40 and to inhibit rotation of the angled member 1263 and the shaft adapter 126 in the second rotational direction E about the axis 40. The structure of the top surface 1264 of the angled member 1263 and the downwardly extending adapter structure 1212 are configured to engage each other and to allow for rotation of the shaft adapter 1262 relative to the angled member 1263 and the hosel insert in a third rotational direction F about axis 18, and to inhibit rotation of the shaft adapter 126 in the fourth rotational direction G about the axis 18, wherein the fourth rotational direction is opposite the third rotational direction. Similar to the structures 110 and 112 described above, the structures of the top and bottom surfaces 1264 and 1266, the adapter structure 1212, and the hosel structure 714 can be gear teeth or other structure. The structures of surfaces 1264 and 1266, the adapter structure 1212 and the hosel structure 714 can provide the at least two important advantages to the adjustable assembly of improved torsional stability, and indexing or selective adjustment.

In another implementation, a secondary biasing assembly can be applied to the hosel portion 728 and the shaft adapter 762 to apply a biasing force to the hosel portion 728 and the shaft adapter 762 about the hosel axis 40. Accordingly, as the fastener 54 is loosened and the shaft adapter 762 is pulled up in a longitudinal direction alone the axis 40 to clear the adapter structure 712 and the insert structure 710 to allow for rotation of the shaft adapter 762 with respect to the hosel insert 760 about the axis 40 in the first rotational direction E, the secondary biasing assembly applies a force acting on the hosel portion 728 and the shaft adapter 762 to draw them back together in a longitudinal direction along the axis 40. The secondary biasing assembly can act as a spring return to engagement of the adapter and insert structures 712 and 710 following raising, lifting or movement of the shaft adapter 762 with respect to the hosel portion 28 during selective rotational adjustment of the golf club 10 between the plurality of selective locked positions.

Figure 23:
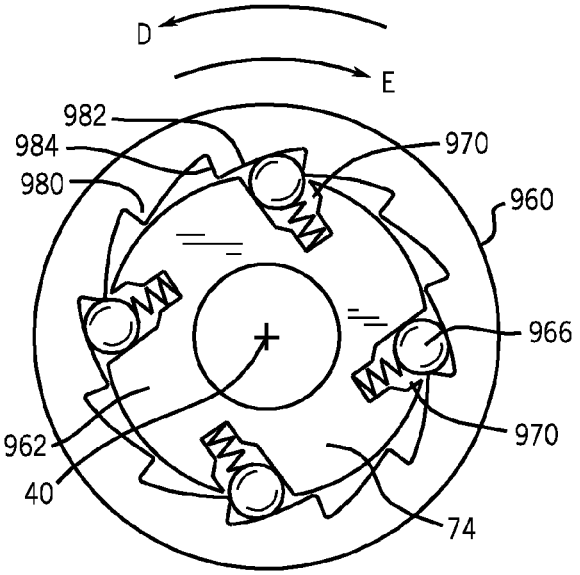
FIG. 23 is a bottom view of a shaft adapter and a hosel insert of a golf club in accordance with another example implementation of the present invention.
Figure 24:
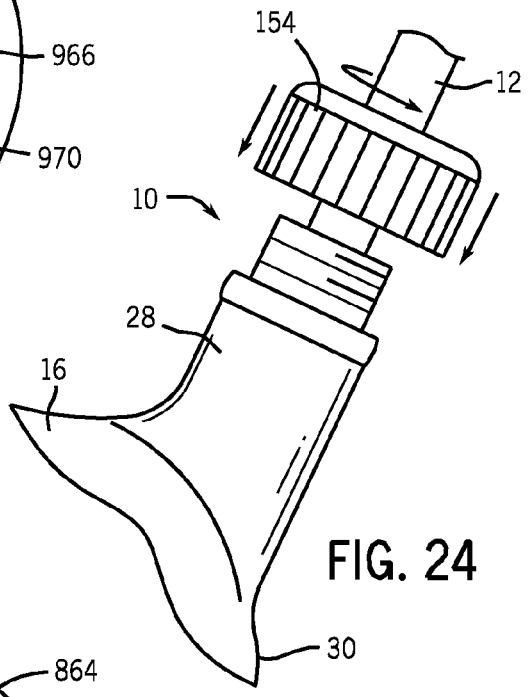
FIG. 24 is a bottom view of a shaft adapter and a hosel insert of a golf club in accordance with another example implementation of the present invention.

Referring to FIG. 23, an alternate implementation of the present invention is illustrated. In the previously discussed implementations, the hosel insert 60 includes at least one pawl for engaging teeth 80 or other projection on the shaft adapter 62. As shown in FIG. 23, the present invention and the above discussed implementations can also be accomplished by reversing the positioning of the pawl and the projections or gear teeth. A hosel insert 860 can be formed with a base element 862 and a plurality of projections 864. In one implementation, the plurality of projections 864 can be a set of gear teeth 880. The gear teeth 880 are substantially the same as the gear teeth 80 discussed above with the exception of instead of outwardly projecting from the shaft adapter 62, the gear teeth 880 inwardly project from the base element 862 of the hosel insert 860. The shaft adapter 862 is substantially the same as the above described shaft adapters, such as adapter 62, with the exception that the shaft adapter 862 does not include outwardly projecting gear teeth. Rather, the shaft adapter 862 can include at least one outwardly projecting pawl 866 for selectable engagement with one of the gear teeth 880 of the hosel insert 860. In one implementation, as shown in FIG. 24, the shaft adapter 862 can includes four angularly spaced apart outwardly projecting pawls 866. The pawls 866 can be positioned within channels 870 defined into the lower region 874 of the shaft adapter 862. A set of biasing elements 820 can be positioned adjacent to the plurality of pawls 866 such that each biasing element 820 urges one of the pawls 866 outward. The biasing elements 820 can also be positioned within the channels 870. When shaft adapter 862 is rotated with respect to the hosel insert 860 in a first rotational direction D, the distal end 868 of each pawl 866 is configured to move up the leading edge 882 of the one of the gear teeth 880 against the biasing force of the biasing element 820. When the distal end 868 of the pawl 866 reaches the trailing edge 884, the biasing element 820 urges the distal end 868 of the pawl 866 outward into one of the gullets 886 of the gear teeth 880. Like the shaft adapters and hosel inserts described above in other implementations, the shaft adapter 862 and the hosel insert 860 are configured to inhibit rotation of the adapter 862 with respect to the insert 860 about the hosel axis 40 in a second rotational direction E. In other implementations, other numbers of pawls can be used. In other implementations, biasing elements 820 can take a different configuration, or can be eliminated altogether. The pawl 866 can be configured to be resilient and spring return to an outwardly projected position. In other implementations, the plurality of projections 864 can be other forms of projections that are not gear teeth.

Referring to FIG. 24, another alternate implementation of the present invention is illustrated. Like the implementation of FIG. 23, a hosel insert 960 can be configured with a plurality of inwardly extending projections, such as gear teeth 980, and a shaft adapter 962 can be configured with at least one pawl 966. The pawl 966 can take the shape of a cylindrical rod, or a sphere or other shape. The at least one pawl 966 can be four pawls as shown, or any other number of pawls. The pawls 966 can be outwardly biased by a plurality of biasing members 920 positioned in a set of channels 970. The orientation of pawls 966 and the biasing members 920 within the channels 970 can be such that the pawls 966 outwardly project from the shaft adapter 962 at an angle with respect to a radial outward projection. The pawls 966 are configured to operatively and selectively engage the gear teeth 980. When the shaft adapter 962 is rotated in the first rotational direction D with respect to the hosel insert 960 about the hosel axis 40, the pawl 966 can be configured to ride up and along the leading surface 982 of the gear tooth 980, and then project outward by the biasing force applied by the biasing member 920 into one of a plurality of gullets 986. When the shaft adapter 962 is attempted to be rotated with respect to the hosel insert 960 in the second rotational direction E, a trailing surface 984 of the gear tooth 980 bears against the at least one pawl 966 and the pawl 966 inhibits rotational movement in the second rotational direction E. The channels 970 and the pawls 966 can be designed such that the pawl 966 cannot retract into the channel 970 when a rotational force in the second rotational direction E is applied to the pawl 966. As with the other previously described implementation, other variations of the gear teeth, pawls, and/or channels can be used.

The present invention contemplates the incorporation of any ratchet and pawl combination in a hosel adjustment assembly of the golf club 10. The ratchet and pawl combination enables the pawl and ratchet components to remain in engagement during the selective adjustment of the adjustment assembly of the golf club 10 between the plurality of selective positions. The ratchet and pawl combinations, when the fastener of the assembly is loosened, allow the shaft adapter to be rotated with respect to the hosel insert about the first rotational direction D, but inhibit rotation of the shaft adapter with respect to the hosel insert about the second rotational direction E. In this manner selective indexing or repositioning of the adjustable hosel assembly can be accomplished, quickly, easily and efficiently without separating the shaft 12 from the club head 16 and without removing the fastener from the club head.

Figure 25:
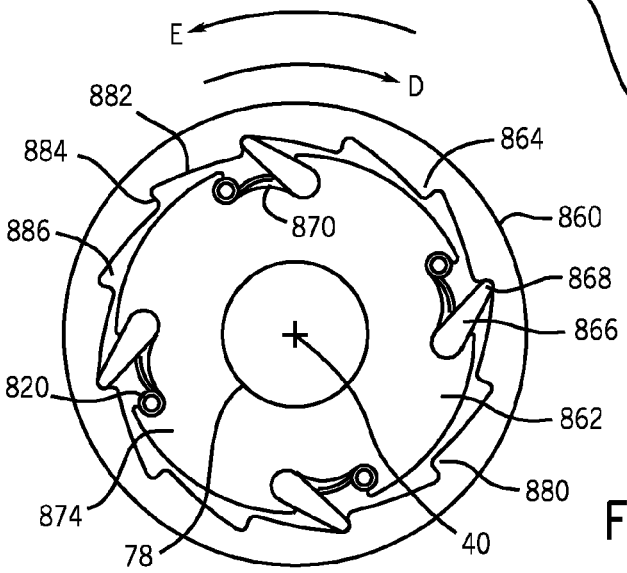
FIG. 25 is a front view of an adjustable assembly of a golf club in accordance with another example implementation of the present invention.

Referring to FIG. 25, in another implementation, the shaft adapter 62 can be removably and fixedly secured to the hosel portion 28 through a fastener 154 at the upper end 96 of the hosel portion 28. In this implementation, the fastener 54 extending through the bottom or sole of the club head 16 is not required.

Figure 28:
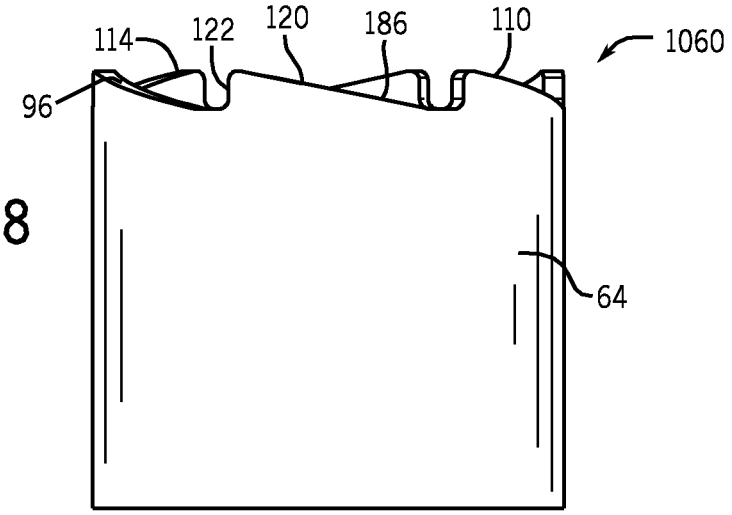
FIG. 28 is a side view of a hosel insert in accordance with another implementation of the present invention.
Figure 29:
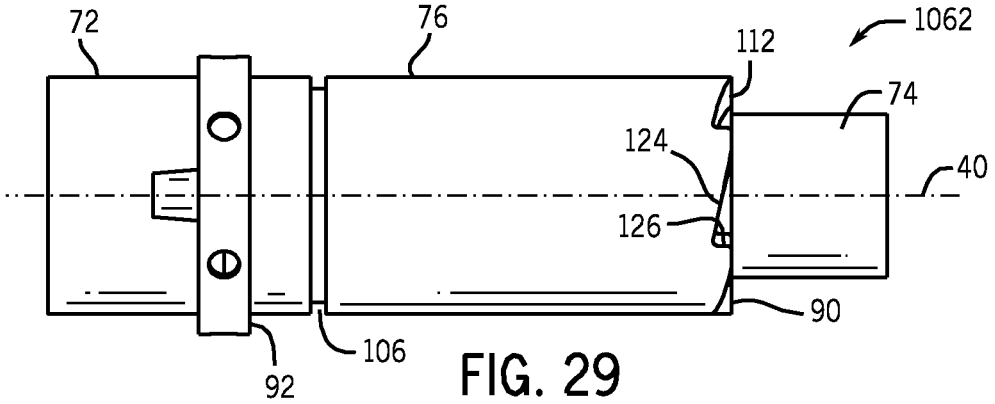
FIG. 29 is a side view of a shaft adapter configured for engagement with the hosel insert of FIG. 28.
Figure 30:
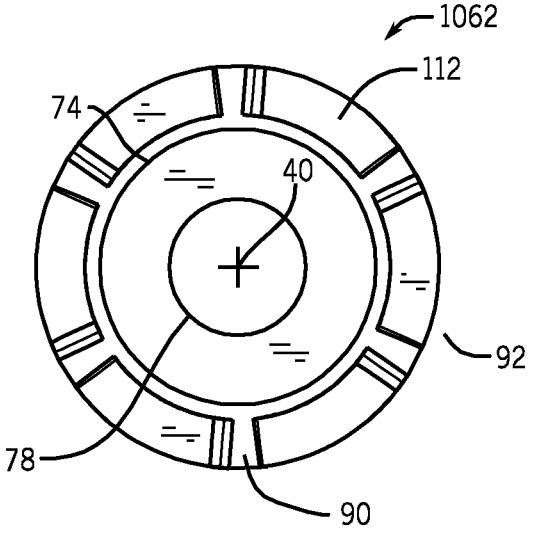
FIG. 30 is a bottom view of the shaft adapter of FIG. 29.

Referring to FIGS. 28 through 30, another alternative implementation of the adjustable assembly of the golf club 10 is illustrated. The adjustable assembly includes a hosel insert 1060 and a shaft adapter 1062, which are substantially the same as the hosel insert 560 and the shaft adapter 562 discussed above, except for the absence of the at least one pawl 66 inwardly projecting from the hosel insert 560, and the absence of gear teeth 80 on the lower region 74 of the shaft adapter 562. Similar to the hosel insert 560, the upper surface 96 of the hosel insert 1060 includes insert structure 110 configured to selectively engage adapter structure 112 included on the first shoulder 90 of the shaft adapter 1062. The insert structure 110 and the adapter structure 112 can be a plurality of projections and recesses shaped and sized to matably and operably engage each other. In one implementation, the insert structure 110 and the adapter structure 112 are shaped and sized to enable relative movement of the upper surface 96 and the first shoulder 90 in the first rotational direction D, and inhibit relative movement of the upper surface 96 and the first shoulder 90 in the second rotational direction E. The lower region 74 of the shaft adapter 1062 is generally cylindrically shaped without outwardly projecting gear teeth or other outwardly projecting structure. Similarly, the hosel insert 1060 is formed without at least one inwardly projecting pawl.

The insert and adapter structures 110 and 112 are substantially the same as the structures 110 and 112 described above with respect to the hosel insert 560 and the shaft adapter 562. The insert and adaptive structure 110 and 112 can be configured for facilitating the initial positioning and/or centering of the shaft adapter 262 within the hosel insert 260, and selective indexing or discrete rotational positioning of the shaft adapter 262 with respect to the hosel insert 260. The insert and adapter structures 110 and 112 can be configured for enabling the rotational positioning of the shaft adapter 1062 with respect to the hosel insert 1060 about the axis 40 in the first rotational direction D while inhibiting rotational movement of the shaft adapter 1062 with respect to the hosel insert 1060 in the second rotational direction E. The insert and adapter structures 110 and 112 provide and define the plurality of selective locked positions of the golf club 10.

Figure 31:
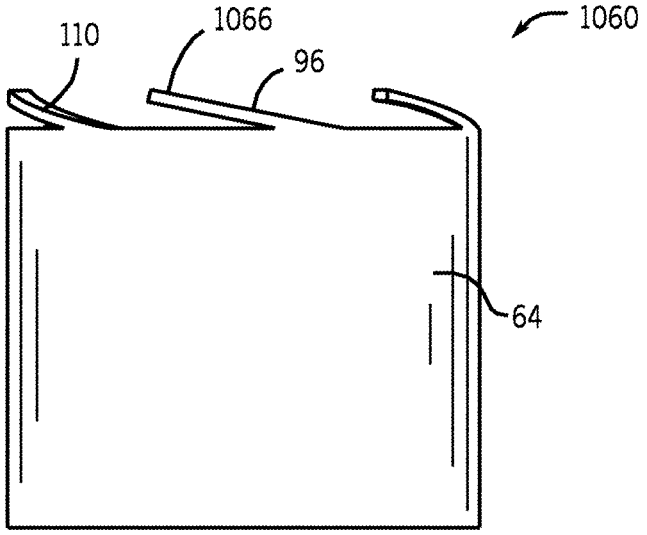
FIG. 31 is a side view of a hosel insert in accordance with another implementation of the present invention.

Referring to FIG. 31, in another implementation, one of the insert structure 110 and the adaptive structure 112 can include at least one secondary pawl 1066 configured to engage the other of the insert structure 110 and the adaptive structure 112. In one implementation, the at least one secondary pawl 1066 is at least two spaced apart pawls 1066. Like the pawl 66, the at least one pawl 1166 can be 1 to 16 pawls. Other characteristics of the at least one pawl 66 as described above are applicable to the at least one pawl 1066 except for its orientation and positioning on the one of the shaft adapter and the hosel insert. The pawl 1066 can downwardly project from the shaft adapter 1062 or upwardly project from the hosel insert 1060.

Similar to the shaft adapter 62, the central region 76 of the shaft adapter 562 also can define a marker 106. The marker 106 is formed within the outer periphery of the central region 76 and is advantageously placed beneath the second shoulder 92 by a first predetermined distance d measured with respect to the hosel axis 40. In other implementations, other forms of markers or markings can be used in lieu of or in addition to the groove. The distance d provides an indication to the user of when the shaft adapter 562 is sufficiently longitudinally moved away from the hosel portion 36 of the club head 16 so as to allow the shaft adapter structure 112 to disengage from the hosel insert structure 114 while at least a portion of one of the pawls 66 of the hosel insert 560 remains engaged to the teeth 80 of the lower region 74 of the shaft adapter 562. When the shaft adapter 562 is longitudinally moved to the distance d, the shaft adapter 562 is free to rotate in the first rotational direction D with respect to the hosel insert 560 for easy adjustment between the plurality of selectable positions. In one implementation, the first predetermined distance d is approximately the same as the height of the adapter structure 112 measured with respect to the longitudinal axis 40. In another implementation, the distance d is equal to or larger than the height of the adapter structure 112.

The insert structure 110 and adapter structure 112 provide at least two important benefits to the golf club 10. The insert structure 110 and adapter structure 112 provide additional support to the adjustable assembly including torsional support. When the shaft adapter 562 is fixedly secured to the hosel insert 560 and the hosel portion 28, the insert structure 110 and the adapter structure 112 provide additional bearing surfaces enable the golf club 10 to retain its torsional stability even upon impact with a golf ball. Additionally, during selectable adjustment of the shaft adapter 562 relative to the hosel insert 560, the insert structure 110 and adapter structure 112 provide a redundant indexing or discrete positioning mechanism for identifying when the club head 16 is repositioned relative to the shaft 12 into one of the selectable locked positions.

The adjustable assembly of the golf club 10 described above enables the shaft adapter 562 to be selectively positioned in one of a plurality of selectable locked positions relative to the hosel insert 560 in the first rotational direction D, while inhibiting rotation in the second rotational direction E, and without removing the shaft from the club head 16. Each of the locked positions can define a separate set of golf club characteristics.

The present invention provides numerous advantages over existing hosel adjustment assemblies or systems for golf clubs. The adjustment assembly can be easily, simply and conveniently adjusted to obtain a number of different golf club characteristics. The assembly allows for the efficient adjustment of the club head with respect to shaft without risking the introduction of debris or moisture into the club head to shaft connection. The assembly performs well, and allows for the player to quickly and easily adjust the club head even during a round to match the golfer's particular needs or objectives at that time. The present assembly also can be readily adjusted into a variety of different settings thereby eliminating the need for the golfer to carry multiple clubs to meet the different desired settings. Further, the present invention provides a golf club that meets these needs while also providing an improved, pleasing aesthetic. The adjustment assembly is also configured for use in competitive play including tournament play by satisfying the requirements of The Rules of Golf as approved by the U.S. Golf Association and the Royal and Ancient Golf Club of St. Andrews, Scotland effective Jan. 1, 2012 ("The Rules of Golf"). Accordingly, the term "assembly is configured for organized, competitive play" refers to a golf club with a hosel adjustment assembly that fully meets the golf shaft rules and/or requirements of The Rules of Golf.

While the preferred embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. An adjustable assembly comprising:

a golf club shaft having a tip portion;

a golf club head including a body having a crown, a sole, a striking plate and a hosel portion, the hosel portion defining an upper hosel opening;

a hosel insert secured to the hosel portion, the hosel insert including a base element and at least one inwardly extending pawl having a distal end;

a shaft adapter extending about a first longitudinal axis, the shaft adapter defining a shaft opening for engaging the tip portion of the shaft; the shaft adapter including a plurality of outwardly projecting teeth aligned with the hosel insert, each tooth including a leading surface and a trailing surface, the leading surface shaped to enable rotational movement of the shaft adapter about the first longitudinal axis with respect to the hosel insert in a first rotational direction, the trailing surface shaped to selectively engage the distal end of the pawl to inhibit rotational movement of the shaft adapter with respect to the hosel insert in a second rotation direction, opposite the first rotational direction; and a fastener releasably coupled to the club head and the shaft adapter, wherein the assembly is adjustable between a plurality of locked positions, each of the plurality of locked positions defining at least one separate loft position, lie position, face angle position, or any combination thereof of the club head with respect to the shaft, wherein the assembly is adjustable between the plurality of locked positions by loosening the fastener, rotating the shaft adapter in a first rotational direction without removing the plurality of teeth of the shaft adapter from the hosel insert, and tightening the fastener.

2. The assembly of claim 1, wherein the shaft extends along a second longitudinal axis, and wherein the first and second longitudinal axes are angled with respect to each other.

3. The assembly of claim 2, wherein the first and second longitudinal axis define a first angle, and wherein the first angle is within the range of 0.25 to 4 degrees.

4. The assembly of claim 3, wherein the first angle is within the range of 0.5 to 2.0 degrees.

5. The assembly of claim 1, wherein the shaft adapter includes a lower region, an upper region and a central region between the lower and upper regions.

6. The assembly of claim 5, wherein the plurality of outwardly projecting teeth project from the lower region of the shaft adapter.

7. The assembly of claim 5, wherein the outer diameter of the lower region of the shaft adapter is less the outer diameter of the central region.

8. The assembly of claim 5, wherein the plurality of outwardly projecting teeth project from the central region of the shaft adapter.

9. The assembly of claim 5, wherein the lower region of the shaft adapter defines a lower opening, and wherein the fastener is a threaded fastener extending through a portion of the club head and into the lower opening.

10. The assembly of claim 1, wherein the base element of the hosel insert is an annular member fixedly secured to the hosel portion.

11. The assembly of claim 10, wherein the at least one inwardly extending pawl is two pawls.

12. The assembly of claim 10, wherein the at least one inwardly extending pawl is three pawls.

13. The assembly of claim 10, wherein the at least one inwardly extending pawl is four pawls.

14. The assembly of claim 10, wherein the at least one inwardly extending pawl is six pawls.

15. The assembly of claim 1, further comprising at least one spring associated with and outwardly biasing the at least one pawl.

16. The assembly of claim 1, wherein the plurality of locked positions define a plurality of separate loft positions, and wherein loft angle is defined as the angle between a center striking plate normal vector and a ground plane when the head is in a square face address position.

17. The assembly of claim 16, wherein the plurality of separate loft angles are selected from the group consisting of the range of 8.0 to 10.5 degrees, the range of 8.5 to 11.5 degrees, the range of 9.5 to 12.0 degrees, the range of 12.0 to 14.5 degrees, the range of 12.5 to 15.5 degrees, the range of 14.0 to 17.0 degrees, the range of 16.0 to 19.0 degrees, the range of 16.0 to 18.0 degrees, the range of 18.0 to 20 degrees, the range 20 to 22 degrees, and the range of 22.0 to 24.0 degrees.

18. The assembly of claim 1, wherein the plurality of locked positions define a plurality of separate lie positions, wherein each lie position defines a separate lie angle within the range of 50.0 to 66.0 degrees, and wherein lie angle is defined as the angle between the first longitudinal axis and a ground plane when the club head is in a grounded address position.

19. The assembly of claim 1, wherein the distal end of the pawl define a pawl height measured with respect to the first longitudinal axis, wherein the teeth define a teeth height measured with respect to the first longitudinal axis, and wherein at least 20 percent of pawl height overlaps a portion of the teeth height during the rotational adjustment of the shaft adapter with respect to the hosel insert.

20. The assembly of claim 1, wherein the shaft adapter includes a shoulder, and wherein the shoulder bears against an upper end of the hosel portion.

21. The assembly of claim 20, wherein the hosel portion includes a hosel flange, and wherein when the assembly is in one of the plurality of locked positions, a lower end of the shaft adapter is spaced apart from the hosel flange.

22. The assembly of claim 20, wherein the hosel portion includes a hosel flange, and wherein when the assembly is in one of the plurality of locked positions, a lower end of the shaft adapter engages the hosel flange.

23. The assembly of claim 1, wherein at least one of the hosel insert and the shaft adapter generate an audible sound when the shaft adapter is rotated with respect to the hosel assembly in the first rotational direction between the plurality of locked positions.

24. The assembly of claim 1, wherein the shaft adapter includes a marker defined by at least one of at least one marking on the shaft adapter, one or more recesses formed in the shaft adapter, and one or more outwardly extending projections on the shaft adapter.

* * * * *